US008229154B2

(12) United States Patent
Ito

(10) Patent No.: US 8,229,154 B2
(45) Date of Patent: Jul. 24, 2012

(54) HEADPHONE DEVICE

(75) Inventor: Tomohiro Ito, Tokyo (JP)

(73) Assignee: Sony Corporation, Tokyo (JP)

( * ) Notice: Subject to any disclaimer, the term of this patent is extended or adjusted under 35 U.S.C. 154(b) by 1308 days.

(21) Appl. No.: 11/973,508

(22) Filed: Oct. 9, 2007

(65) Prior Publication Data

US 2008/0089544 A1 Apr. 17, 2008

(30) Foreign Application Priority Data

Oct. 11, 2006 (JP) ..... 2006-277872

(51) Int. Cl.
*H04R 1/10* (2006.01)

(52) U.S. Cl. ..... 381/385; 381/370; 242/378.4

(58) Field of Classification Search ..... 381/182, 381/370, 374, 385, 383; 242/378, 378.4
See application file for complete search history.

(56) References Cited

U.S. PATENT DOCUMENTS

| | | | | |
|---|---|---|---|---|
| 6,179,238 | B1 * | 1/2001 | Phillipps | 242/378.4 |
| 7,174,196 | B2 * | 2/2007 | Matsuda | 455/575.6 |
| 2003/0068062 | A1 | 4/2003 | Huang | |
| 2005/0115999 | A1 | 6/2005 | Johnson | |
| 2006/0205441 | A1 | 9/2006 | Matsuda | |

FOREIGN PATENT DOCUMENTS

| | | | |
|---|---|---|---|
| GB | 2280168 | A * | 1/1995 |
| JP | 6-269073 | | 9/1994 |
| JP | 8-237349 | | 9/1996 |
| JP | 3042662 | | 8/1997 |
| JP | 2001-127864 | | 5/2001 |
| JP | 2005-51805 | | 2/2005 |
| JP | 2005 311777 | | 11/2005 |
| KR | 2005027391 | A * | 3/2005 |

* cited by examiner

*Primary Examiner* — Ramon Barrera
(74) *Attorney, Agent, or Firm* — Frommer Lawrence & Haug LLP; William S. Frommer; Paul A. Levy

(57) ABSTRACT

The present invention provides a more excellent headphone device that is provided with the portability and operability as compared with that in the past. The present invention provides a device that is connected to an electronic device through a connecting cord which includes a housing, a reeling section that reels up a headphone cord of a headphone to the inside of the housing, an attachment section that is arranged on the housing, and is to be attached to the user, and a link section that physically links any one of the housing and the attachment section to the electronic device.

12 Claims, 25 Drawing Sheets

HEADPHONE DEVICE

CROSS REFERENCES TO RELATED APPLICATIONS

The present invention contains subject matter related to Japanese Patent Application JP2006-277872 filed in the Japanese Patent Office on Oct. 11, 2006, the entire contents of which being incorporated herein by reference.

BACKGROUND OF THE INVENTION

1. Field of the Invention

This invention relates to a headphone device that can be suitably applied to a headphone provided with a cord-reeling mechanism used for, for example, a portable music player.

2. Description of the Related Art

Generally, in an electronic product to which a cord for supplying power or audio signals is attached, a cord-reeling mechanism to reel up the cord is provided. In a headphone and a headset in which a microphone is attached to a headphone, in order to mainly prevent a cord from tangling at the time of storing the cord, it is not unusual that a cord-reeling mechanism is provided (for example, refer to Patent Document 1: Jpn. Pat. Appln. Laid-Open Publication No. 2005-311777).

On the other hand, as cellular phones are coming to be provided with multiple functions, and various portable devices such as a portable music player that reproduces a few hundred or a few thousand of pieces of music are being developed, a usage method that takes more convenient portability into consideration is demanded also for a headphone.

A headphone is often connected to a portable music player that is appended at the chest of the user through a strap hung from the neck to be used, or connected to a portable music player that is put in a chest pocket of clothes or a bag to be used.

SUMMARY OF THE INVENTION

Meanwhile, when thus configured headphone is connected to a portable music player appended at the chest of the user through a strap hung from the neck to be used, since the portable music player is heavy as compared with a pendant etc., there are raised inconvenient problems that the user feels uncomfortable, or feels a sensation of pressure to the chest when walking up and down the stairs, and furthermore, the portable music player is offending when putting off a jacket, or gets wet with water when the user turns down his or her upper body to wash hands.

On the other hand, when the headphone is connected to a portable digital audio player put in a chest pocket of clothes to be used, there are also raised problems that the portable digital audio player falls down when the user turns down his or her upper body, and the clothes are restricted due to the weight, size, etc. of the player.

Furthermore, when the headphone is connected to a portable music player put in a bag to be used, there are also raised problems that the shape of the bag is restricted due to the portable music player, and in the state of being put in the bag, operations for convenient functions or displaying song titles, adjusting sound volumes, selecting music are not easily performed.

In view of the above-identified circumstances, it is therefore desirable to provide a more excellent headphone device that is provided with the portability and operability as compared with that in the past.

According to an embodiment of the present invention, there is provided a device that is connected to an electronic device through a connecting cord including: a housing; a reeling section that reels up a headphone cord of a headphone to the inside of the housing; an attachment section that is arranged on the housing, and is to be attached to the user; and a link section that physically links any one of the housing and the attachment section to the electronic device.

According to the present invention, when the electronic device and the housing are linked by the link section to be attached to the user, and the housing is attached to the user through the attachment section, since the electronic device and the housing are linked, there are brought about advantages that botheration can be significantly reduced as the degree of freedom of the motion of the electronic device is small when attached to the user, and that the operability with respect to the electronic device is not lost as the electronic device is attached to the user, which can realize a more excellent headphone device that is provided with the portability and operability as compared with that in the past.

The nature, principle and utility of the invention will become more apparent from the following detailed description when read in conjunction with the accompanying drawings in which like parts are designated by like reference numerals or characters.

DETAILED DESCRIPTION OF THE PREFERRED EMBODIMENTS

Hereinafter, embodiments of the present invention will be described in greater detail by referring to the accompanying drawings.

Figure 1:
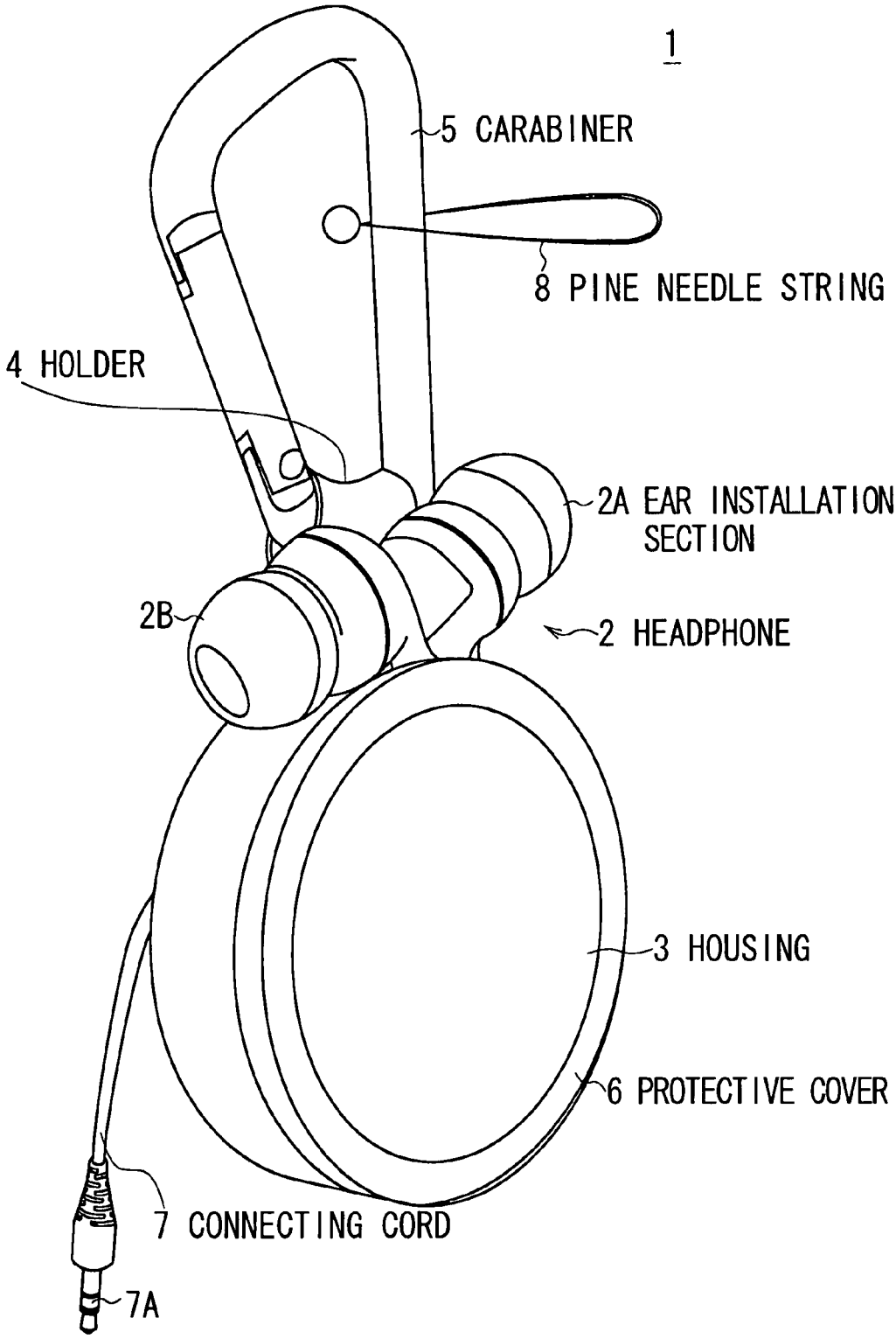
FIG. 1 shows a perspective view indicative of the exterior appearance configuration (1) of a headphone device in the first embodiment.
Figure 2:
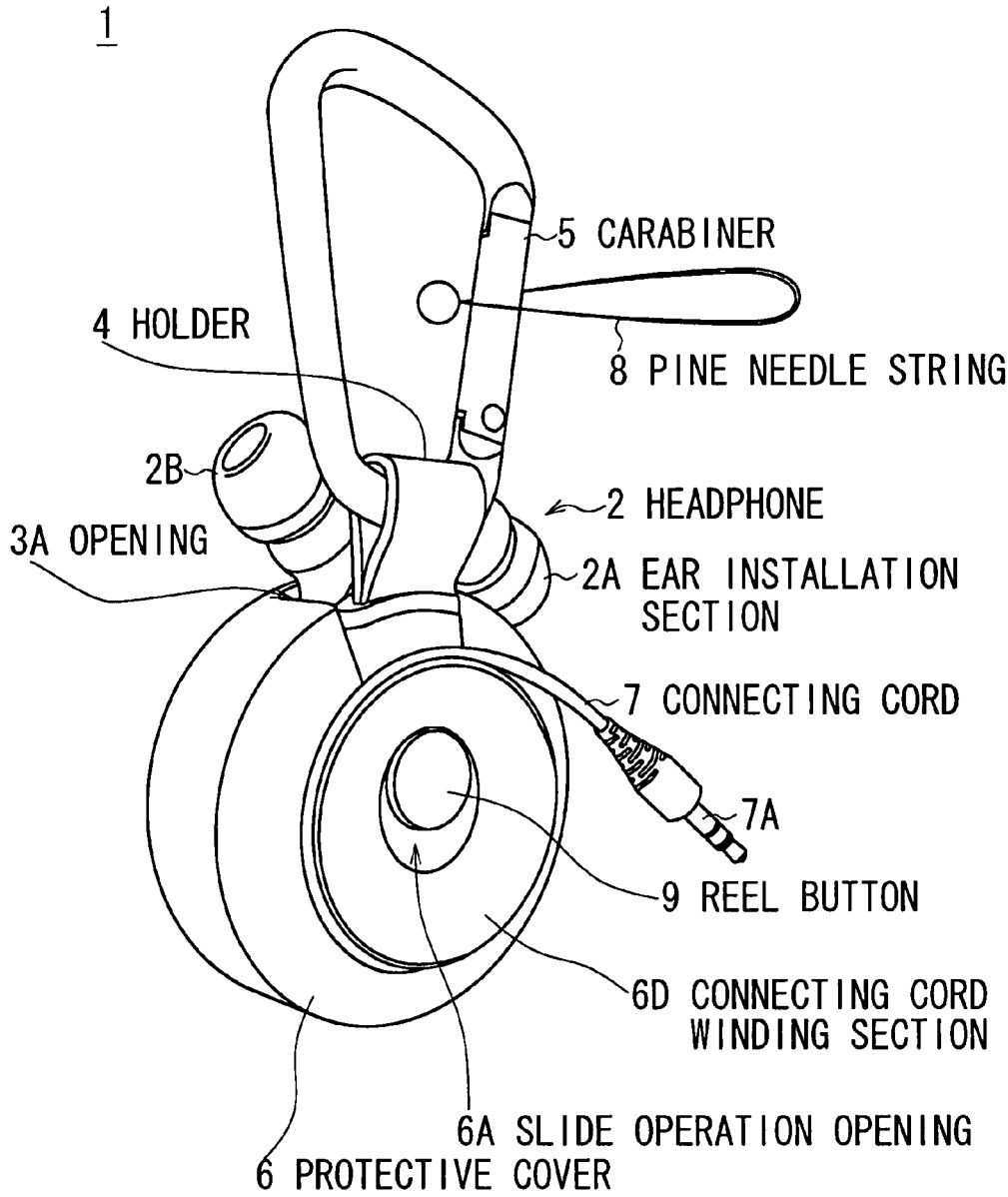
FIG. 2 shows a perspective view indicative of the exterior appearance configuration (2) of the headphone device in the first embodiment.
Figure 3:
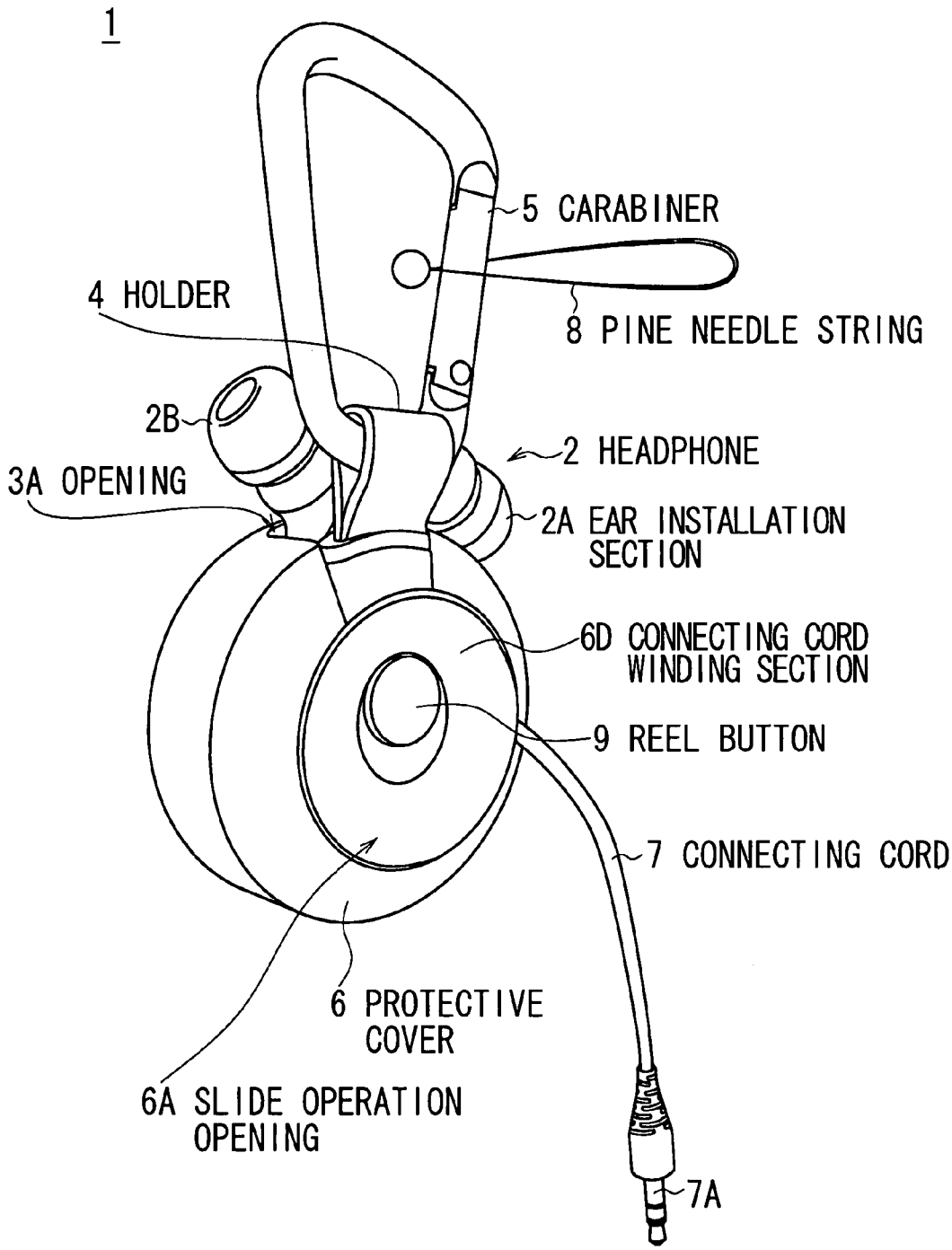
FIG. 3 shows a perspective view indicative of the exterior appearance configuration (3) of the headphone device in the first embodiment.

(1) First Embodiment (1-1) External Appearance Configuration of a Headphone Device in the First Embodiment In FIG. 1 to FIG. 3, a reference numeral "1" represents a headphone device according to the first embodiment of the present invention. In the headphone device 1, a headphone cord, not shown, of a headphone 2 is reeled up by a reeling mechanism, not shown, arranged in a housing 3 in the form of a cylinder, and a carabiner 5 for use as a hook to be attached to the user is arranged on the housing 3 through a holder 4 that is made of leather and is arranged on the top end of the housing 3.

Figure 4A:
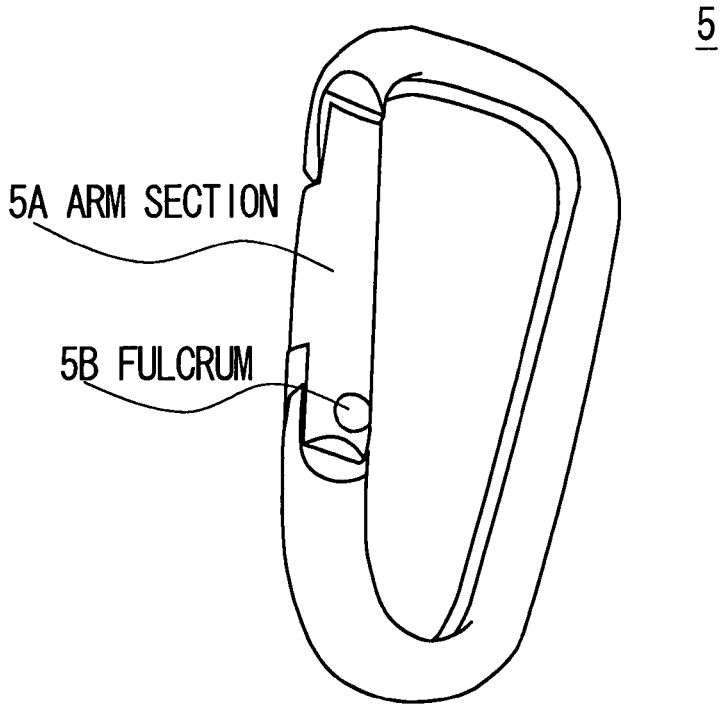
FIG. 4A and FIG. 4B show perspective views indicative of the configuration of a carabiner.
Figure 4B:
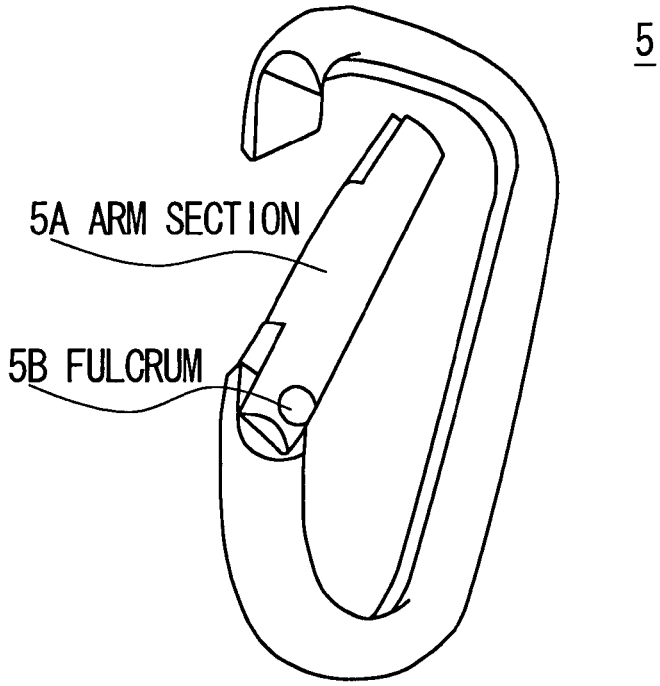

As shown in FIG. 4A and FIG. 4B, the carabiner 5 is substantially in the form of a triangle, and an arm section 5A, which is a part of the carabiner 5, is so configured as to pivot to the inside of the triangle with a fulcrum 5B being the pivot axis. Usually, the arm section 5A is pressed by a biasing force of a spring, not shown, arranged at the inside of the fulcrum 5B to be located to form one side of the triangle, while, when being pressed by the user, the arm section 5A pivots to the inside of the triangle against the biasing force, and the carabiner 5 is attached to, for example, a belt loop of trousers to be attached to the user.

It is supposed that the carabiner 5 is attached to a belt loop of trousers and is adapted to hold the housing 3. On the other hand, in addition, the carabiner 5 is so formed as to have a strength that can stand up to a case in which, for example, a portable music player, not shown, which supplies music signals etc. to the headphone 2 is attached to the carabiner 5 through a pine needle string 8 (FIG. 1 to FIG. 3), or a case in which a key or other objects are attached to the carabiner 5.

In the headphone device 1, through an opening 3A in the form of a rectangle which is provided on the top end of the housing 3, ear installation sections 2A and 2B which are leading ends of the headphone 2 are held. The ear installation sections 2A and 2B have their size made larger than that of the opening 3A, which prevents, when a reel button 9 (FIG. 2 and FIG. 3) is slid downward to operate a reeling mechanism in the housing 3 and a headphone cord of the headphone 2 is reeled up, the ear installation sections 2A and 2B of the headphone 2 from being housed at the inside of the housing 3 to make it difficult to pull out the ear installation sections 2A and 2B therefrom.

Furthermore, in the headphone device 1, a protective cover 6 made of rubber is attached to the surface of the housing 3, which prevents, in case the housing 3 is attached to a portable music player, not shown, with their positions set adjacent to each other through the carabiner 5, both the housing 3 and portable music player from being scratched or damaged when the housing 3 and portable music player come into contact with each other or collide with each other.

Figure 5:
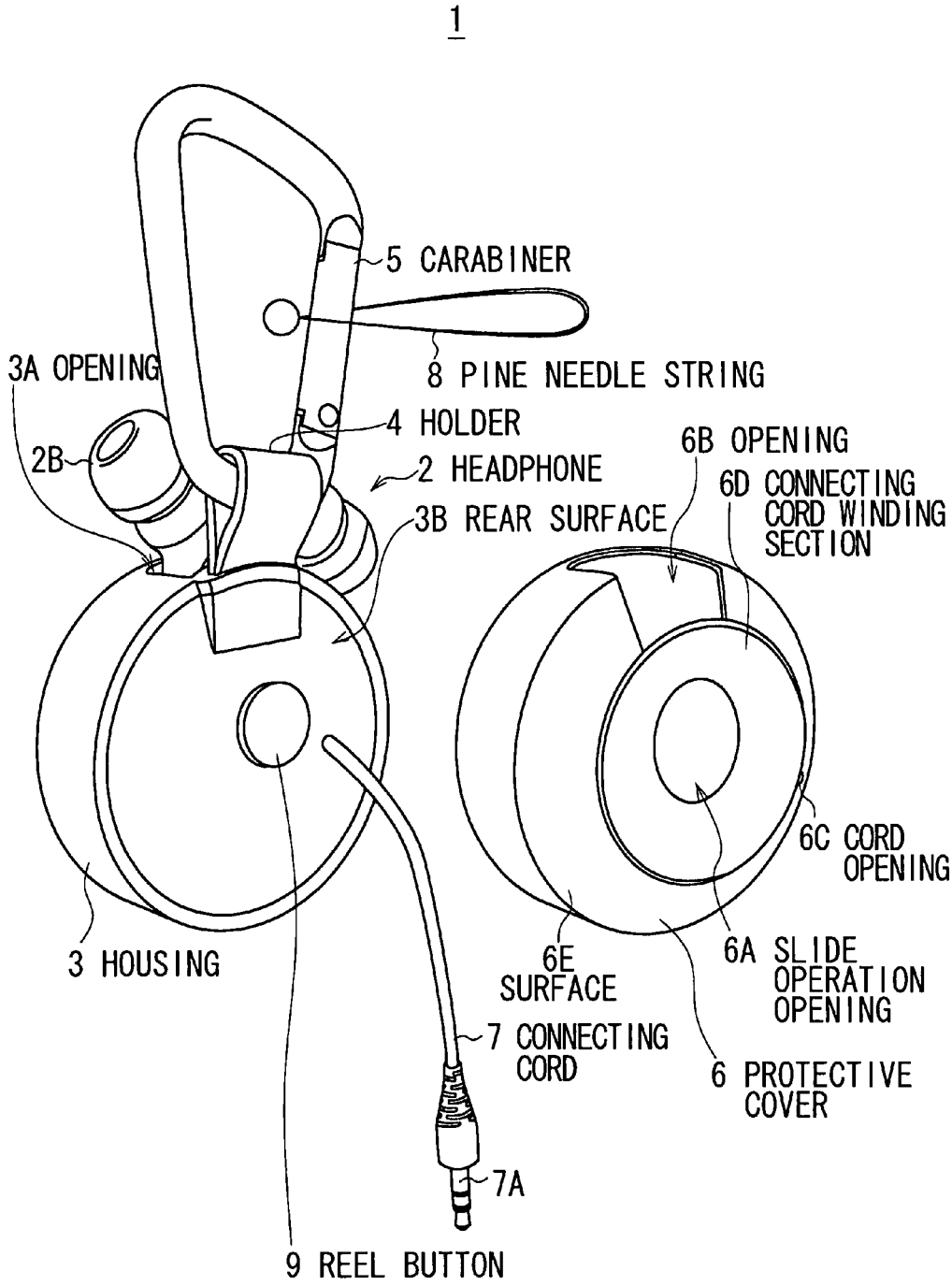
FIG. 5 shows a perspective view indicative of the rear surface of a housing and the structure of a protective cover.

As shown in FIG. 5, in the headphone device 1, from a point near the reel button 9 arranged at the rear surface 3B of the housing 3, which is not covered by the protective cover 6, a connecting cord 7 of a predetermined length to be electrically connected to an electronic device such as a portable music player, not shown, is drawn.

On the other hand, the protective cover 6 for covering the housing 3 is provided with, substantially at the center thereof, a slide operation opening 6A in the form of a vertically long ellipse of a size corresponding to the shift range of the reel button 9 which is operated to be slid downward, and is provided with, at the top end thereof, an opening 6B of a size larger than the size of the opening 3A of the housing 3, and is further provided with a cord opening 6C at a position corresponding to the connecting cord 7 of the housing 3.

The headphone device 1 comes to be a completed device when the housing 3 is covered by the protective cover 6, in which state the connecting cord 7 of the housing 3 is exposed to the outside through the cord opening 6C of the protective cover 6, and the reel button 9 is exposed to the outside through the slide operation opening 6A, and further the holder 4 is exposed to the outside through the opening 6B of the protective cover 6.

Figure 6:
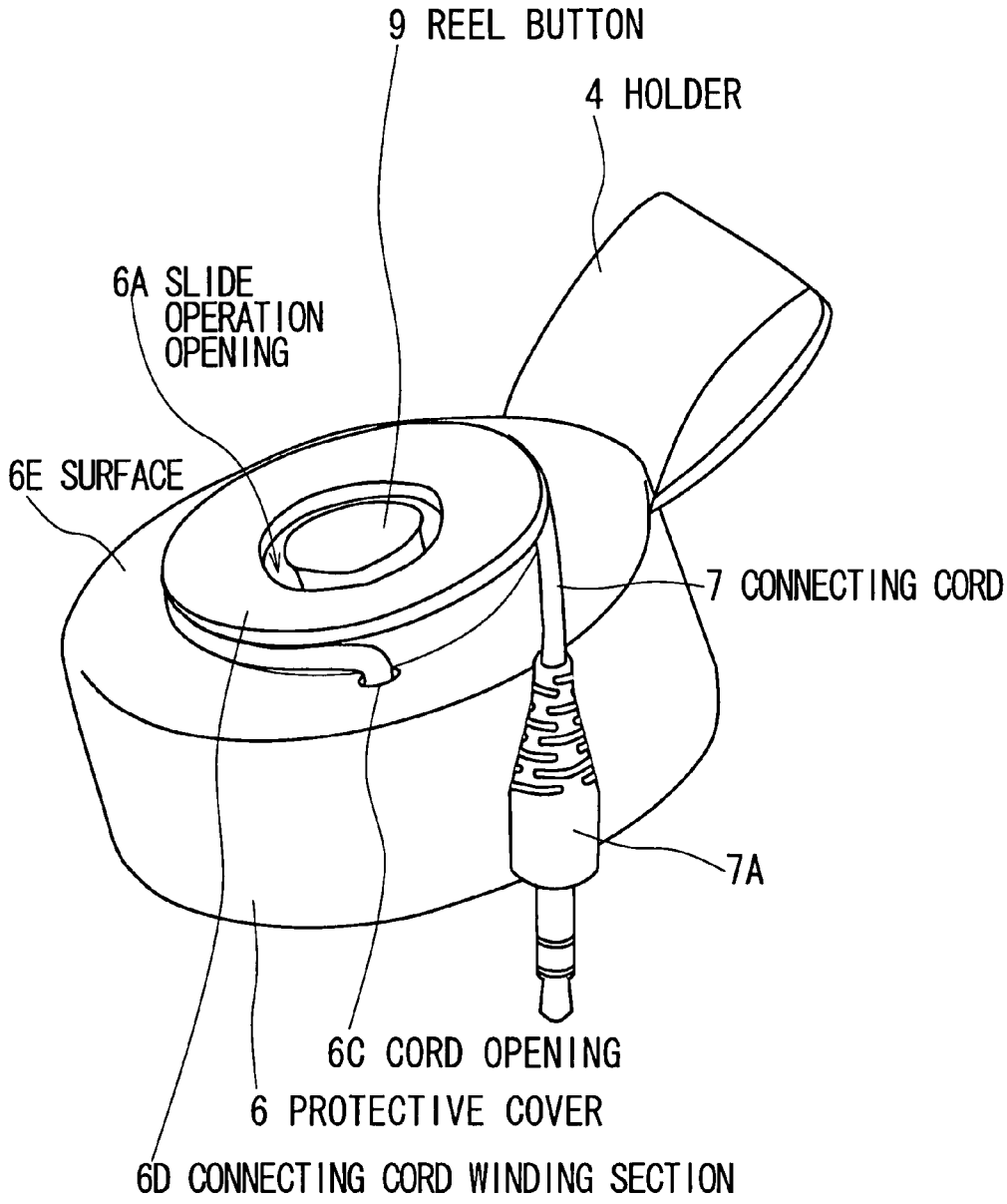
FIG. 6 shows a perspective view to explain the method of adjusting the length of a connecting cord.

Furthermore, the protective cover 6 has formed thereon a connecting cord winding section 6D, around the slide operation opening 6A, which is in the form of a thin ring plate and slightly protrudes from the surface 6E of the protective cover 6, and, as shown in FIG. 6, the connecting cord 7 that is exposed from the cord opening 6C can be wound between the connecting cord winding section 6D and the surface 6E.

Accordingly, since the connecting cord 7 exposed to the outside from the cord opening 6C of the protective cover 6 is wound between the connecting cord winding section 6D and the surface 6E, the headphone device 1 can make the length of the connecting cord 7 short (FIG. 2). On the other hand, when the connecting cord 7 is not wound between the connecting cord winding section 6D and the surface 6E, the headphone device 1 can be used with the length of the connecting cord 7 made maximally long (FIG. 3).

At this time, since the protective cover 6 is made of rubber provided with the elasticity, the connecting cord 7 is sandwiched between the connecting cord winding section 6D and the surface 6E due to the elastic force of the protective cover 6, and can be held at an arbitrary position with its length adjusted according to the wound amount.

Since the connecting cord winding section 6D is so formed as to slightly protrude from the surface 6E of the protective cover 6, the reel button 9 which is exposed at the inner side of the slide operation opening 6A does not protrude from the surface of the connecting cord winding section 6D, which prevents the reel button 9 from being operated carelessly.

In addition, the reel button 9 is not a button of the push operation type but a button of the slide operation type, which also prevents the reel button 9 from being operated incorrectly, and configures a double erroneous operation prevention mechanism together with the configuration in which the reel button 9 does not protrude from the surface of the connecting cord winding section 6D.

Figure 7:
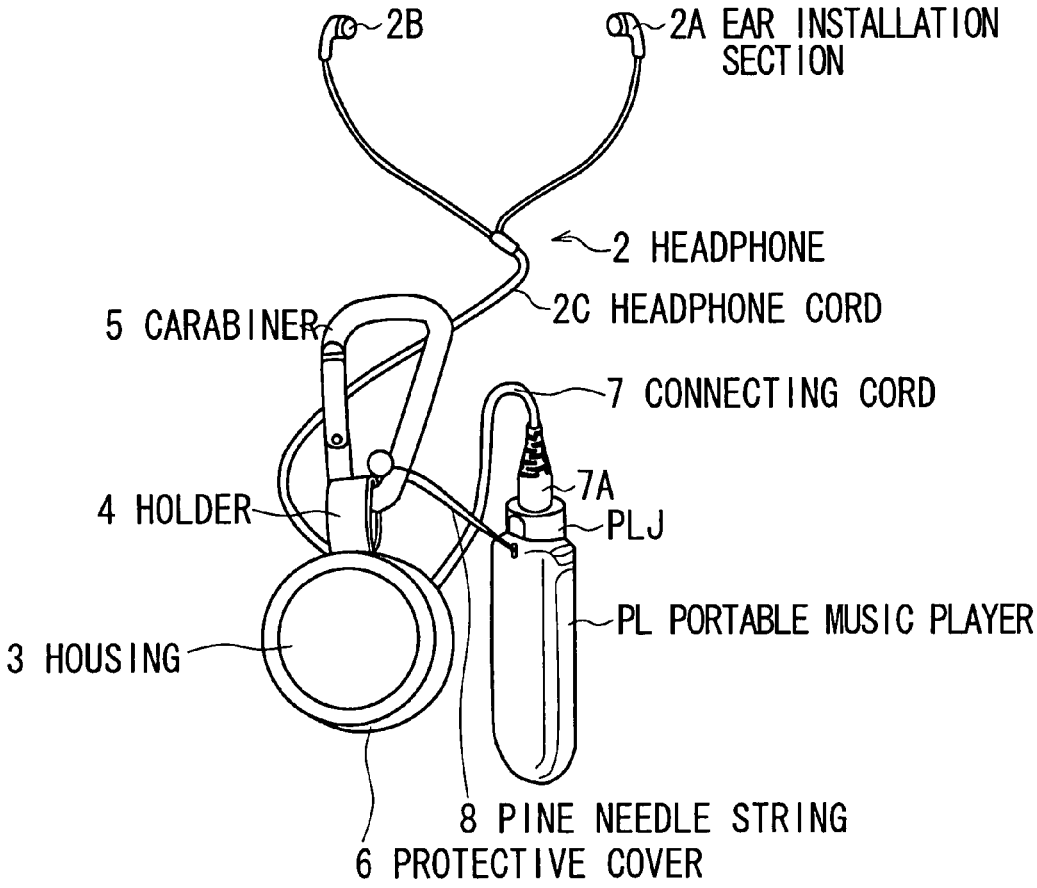
FIG. 7 shows a perspective view indicative of the state in which a portable music player is attached to the headphone device in the first embodiment.

Actually, as shown in FIG. 7, in the headphone device 1, the housing 3 which is covered by the protective cover 6 is attached to the carabiner 5 through the holder 4, and a portable music player PL is linked to the carabiner 5 through the pine needle string 8.

When a plug 7A of the connecting cord 7 exposed from the cord opening 6C of the protective cover 6 is inserted to a jack PLJ of the portable music player PL, the headphone device 1 and the portable music player PL are mechanically and electrically connected.

Accordingly, when the carabiner 5 is attached to a belt loop of trousers, the user carrying the headphone device 1 and portable music player PL about, the headphone device 1 can supply music signals reproduced by the portable music player PL to the headphone 2 through the connecting cord 7, which can make the user listen to music through the ear installation sections 2A and 2B of the headphone 2.

(1-2) Reeling Mechanism of the Headphone Device in the First Embodiment

Next, the configuration of a reeling mechanism arranged at the inside of the housing 3 of the headphone device 1 will be explained.

Figure 8:
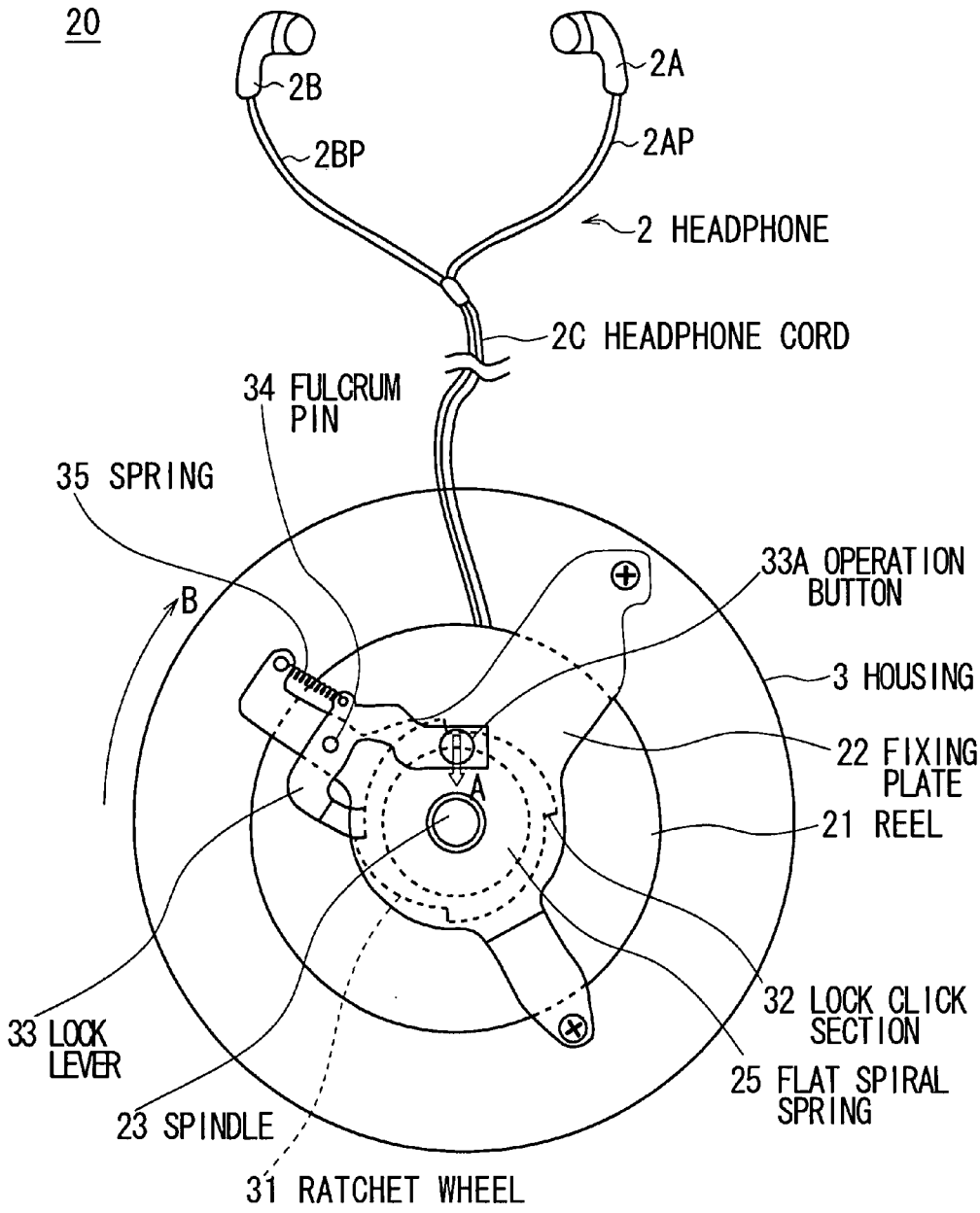
FIG. 8 shows a schematic view indicative of the configuration of a reeling mechanism.
Figure 9:
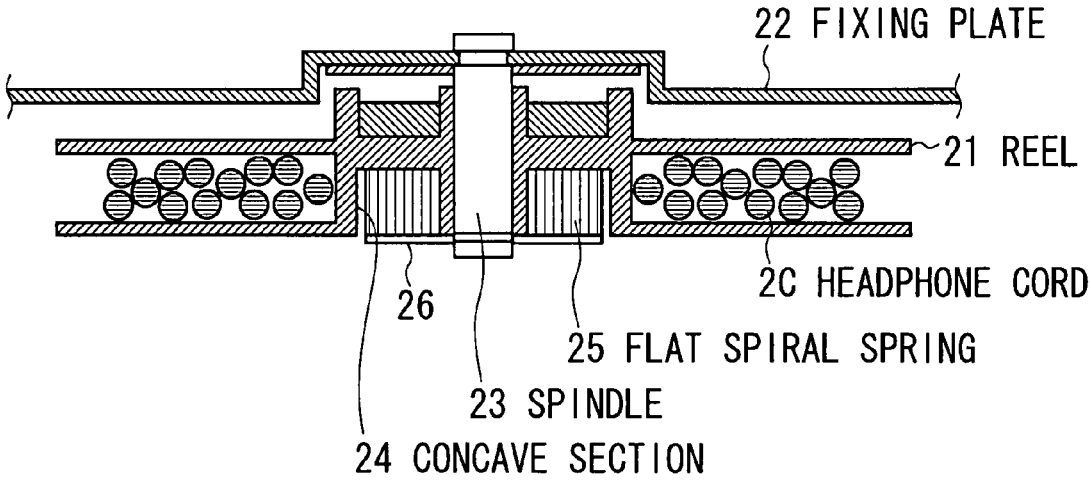
FIG. 9 shows a sectional view indicative of the cross-sectional configuration of a reel.

As shown in FIG. 8 and FIG. 9, in a reeling mechanism 20 arranged at the inside of the housing 3, a reel 21 that is arranged substantially at the center thereof is attached to the housing 3 through a fixing plate 22 in the form of a predetermined figuration, and the reel 21 is rotatably supported by a spindle 23 that is projectingly arranged on the fixing plate 22.

In a concave section 24 which is provided at the lower part of the center side of the reel 21 (FIG. 9) and around the spindle 23, a flat spiral spring 25 for reeling up a headphone cord 2C of the headphone 2 is housed, and the concave section 24 in which the flat spiral spring 25 is housed is covered by a cover section 26.

On the top surface of the reel 21, a ratchet wheel 31 (FIG. 8) is arranged, and a lock lever 33 is arranged such that four lock click sections 32 formed on the ratchet wheel 31 are engaged with the leading end of the lock lever 33, and the lock lever 33 is supported on the fixing plate 22 through a fulcrum pin 34.

The lock lever 33 is substantially in the form of the character "L", and a point near the fulcrum pin 34 and a point of the fixing plate 22 are linked by a spring 35, and usually, the leading end of the lock lever 33 is pressed toward the ratchet wheel 31 by the biasing force of the spring 35.

Furthermore, a slidable operation button 33A is arranged substantially at the center of the housing 3, and when the operation button 33A is slid downward in a direction of an arrow "A", the lock lever 33 pivots in a direction of an arrow "B" being the clockwise direction, with the fulcrum pin 34 being the pivot axis, and the engaged state of the leading end of the lock lever 33 and the lock click sections 32 of the ratchet wheel 31 is released.

Accordingly, in the reeling mechanism 20, the headphone cord 2C of the headphone 2 can be wound around the reel 21 that is rotated by the flat spiral spring 25.

Figure 10:
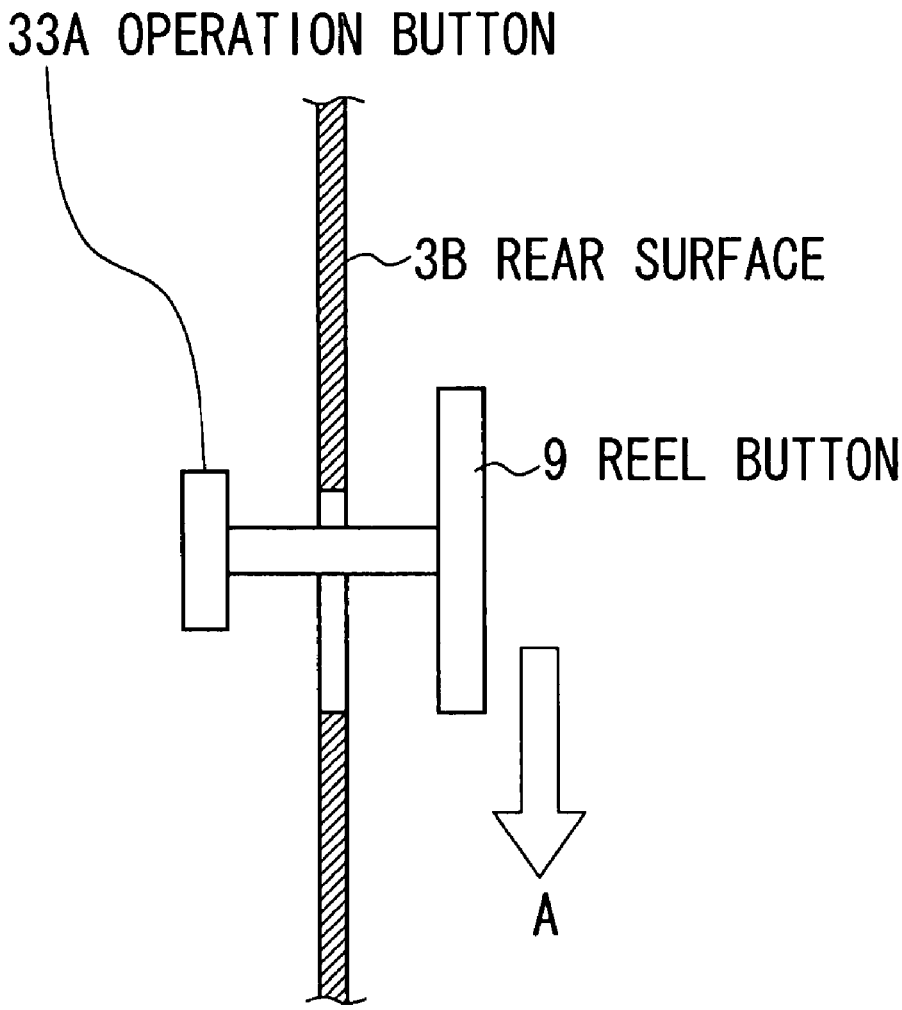
FIG. 10 shows a schematic view indicative of the relationship between a reel button and an operation button.

As shown in FIG. 10, the reel button 9 (FIG. 2, FIG. 3, FIG. 5, and FIG. 6) that is located at the outside of the rear surface 3B of the housing 3 and the operation button 33A that is arranged at the inside of the rear surface 3B are linked, and when the reel button 9 is slid in a direction of the arrow "A", also the operation button 33A is slid in a direction of the arrow "A".

Figure 11A:
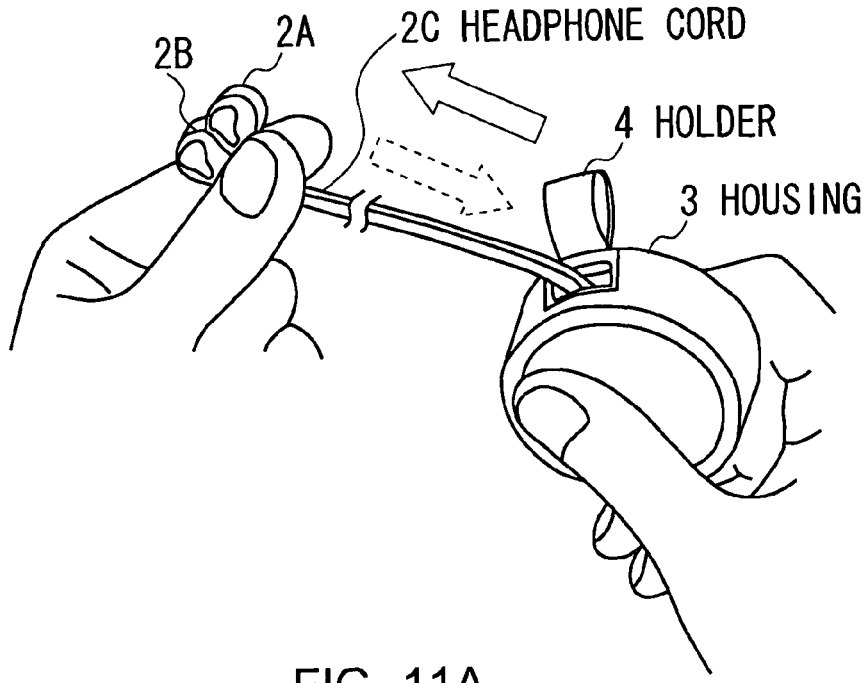
FIG. 11A and FIG. 11B show perspective views to explain the method of reeling up a headphone cord.

In this case, as shown in FIG. 11A, in the headphone device 1, when the user holds the housing 3 with the user's right hand, and holds and pulls out the ear installation sections 2A and 2B of the headphone 2 with the user's left hand, the headphone cord 2C is pulled out against the biasing force of the flat spiral spring 25.

When the user stops pulling out the headphone cord 2C of the headphone 2 from the housing 3 during the pulling out operation, the leading end of the lock lever 33 (FIG. 8) is engaged with the lock click section 32 of the ratchet wheel 31, and the headphone cord 2C has its length kept with a predetermined length.

Figure 11B:
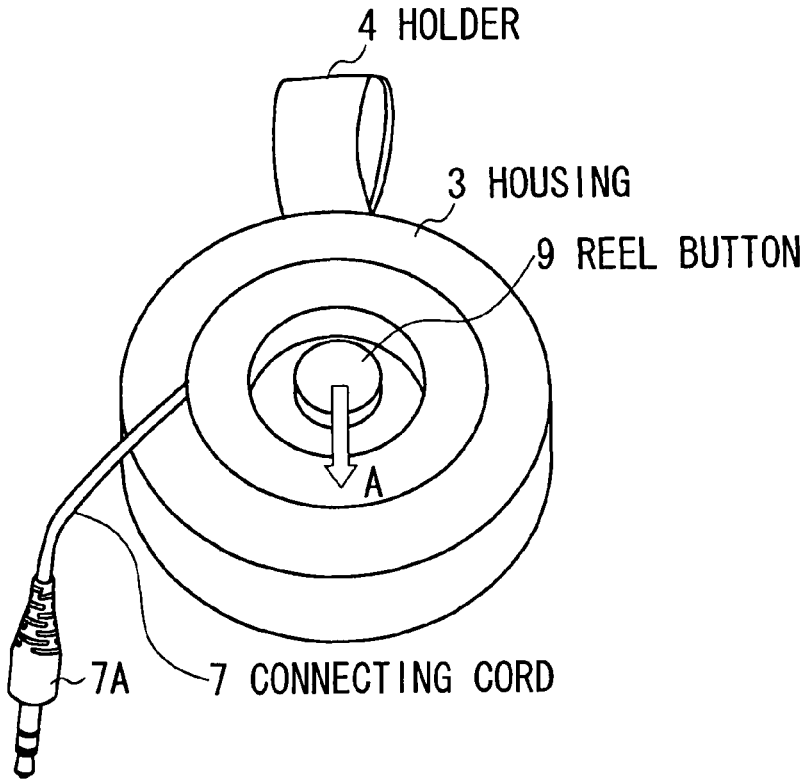

Then, as shown in FIG. 11B, in the headphone device 1, when the reel button 9 arranged at the rear side of the housing 3 is slid downward, the engaged state of the leading end of the lock lever 33 and the lock click section 32 of the ratchet wheel 31 is released, and the headphone cord 2C of the headphone 2 is wound around the reel 21 in the housing 3 due to the biasing force of the flat spiral spring 25.

At this time, since the opening 3A of the housing 3 has its size made smaller than that of the ear installation sections 2A and 2B, when the headphone cord 2C is wound around the reel 21 according to the sliding operation with respect to the reel button 9, the ear installation sections 2A and 2B are held at the opening 3A of the housing 3, and are prevented from being housed at the inside of the housing 3.

In addition, in the headphone device 1 (FIG. 8), the headphone cord 2C of the headphone 2 is branched into two cord parts 2AP and 2BP directed to the ear installation sections 2A and 2B, respectively, from a branch section 2H, and the headphone device 1 is configured so that the two cord parts 2AP and 2BP are not tangled when the headphone cord 2C is reeled up.

Figure 12:
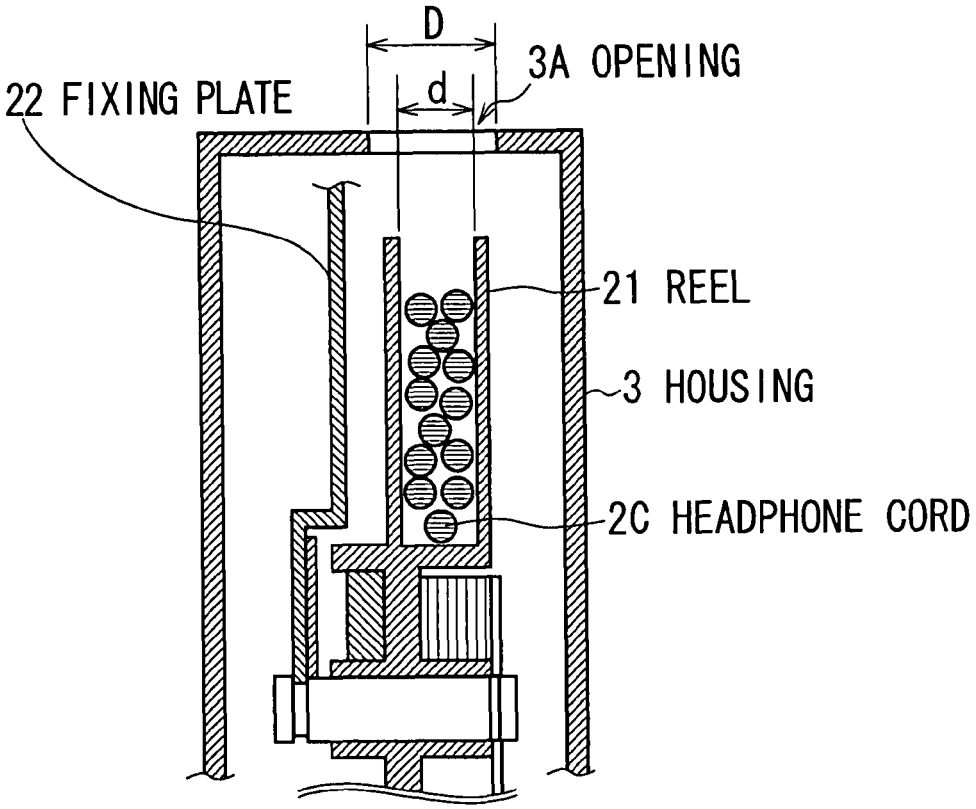
FIG. 12 shows a sectional view indicative of the relationship between the reel and an opening.

Specifically, as shown in FIG. 12, the headphone device 1 is formed such that a width "D" of the opening 3A provided on the top end of the housing 3 is set longer than an inner thickness "d" of the reel 21 of the reeling mechanism 20 along the width direction arranged at the inside of the housing 3.

Accordingly, in the headphone device 1, when the two cord parts 2AP and 2BP of the headphone cord 2C to the ear installation sections 2A and 2B are wound around the reel 21, the degrees of freedom of the two cord parts 2AP and 2BP become large, which prevents the two cord parts 2AP and 2BP from being tangled mutually.

(1-3) Performance and Effect

In above-described configuration, according to the headphone device 1, for example, the housing 3 can be attached to a belt loop of trousers through the carabiner 5, and, under this state, when the user pulls out the ear installation sections 2A and 2B of the headphone 2, the length of the headphone cord 2C can be adjusted to a length desired by the user.

In this state, the headphone device 1 can output music reproduced by the portable music player PL that is linked to the carabiner 5 using the pine needle string 8 from the ear installation sections 2A and 2B of the headphone 2 to make the user listen to thus reproduced music.

In this way, according to the headphone device 1, when being used, the portable music player PL does not come to be located at the chest of the user, and the portable music player PL is not appended at the chest of the user through a strap hung from the neck as in the past, which can prevent the user from feeling a sensation of pressure to the chest, feeling uncomfortable, or feeling a sensation of pressure to the chest when walking up and down the stairs, and furthermore, the portable music player PL is not offending when putting off a jacket, or does not get wet with water of a washstand when the user turns down his or her upper body to wash hands, solving all the inconvenient problems.

Furthermore, according to the headphone device 1, since the portable music player PL is not put in a chest pocket of clothes as in the past, the portable music player PL does not fall down when the user turns down his or her upper body, and clothes are not restricted due to the weight, size, etc. of the portable music player PL.

Furthermore, according to the headphone device 1, since the portable music player PL can be held at the lumbar part of the user, which part is near the user's hands, operations for convenient functions or displaying song titles for the user, adjusting sound volumes, selecting music can be easily performed, improving the convenience for the user significantly.

According to the headphone device 1, since the housing 3 is attached to the user through the carabiner 5, and also the portable music player PL can be attached to the user through the carabiner 5, the housing 3 and portable music player PL are attached to the user in parallel through the carabiner 5. Thus, when attached to a belt loop of trousers through the carabiner 5, the housing 3 and portable music player PL comes to be adjacent to each other like key rings, which can improve the fashionability when the headphone device 1 is used.

Then, when the user only slides the reel button 9 of the housing 3, the headphone device 1 can reel up the headphone cord 2C of the headphone 2 to the inside of the housing 3 instantly.

At this time, in the headphone device 1, since the ear installation sections 2A and 2B of the headphone 2 can be fixed at the opening 3A of the housing 3, the headphone 2 and the ear installation sections 2A and 2B can be protected, and concurrently the ear installation sections 2A and 2B can be prevented from being lost.

Furthermore, when the headphone device 1 is not used, since the headphone cord 2C of the headphone 2 is housed at the inside of the housing 3, the headphone 2 and the headphone cord 2C are not cumbersome around the lumbar part of the user, which can improve the portability and fashionability even when the headphone device 1 is not used.

When the headphone device 1 is attached to clothes of the user, while the portable music player PL linked to the carabiner 5 through the pine needle string 8 and the housing 3 attached to the carabiner 5 collide with each other when the user walks, since the housing 3 is covered by the protective cover 6, both the housing 3 and portable music player PL are prevented from being scratched or damaged.

According to above-described configuration, being provided with the portability and operability concurrently, the headphone device 1 can further become excellent and user-friendly as compared with that in the past.

(1-4) Another Embodiment with Respect to the First Embodiment

In above-described first embodiment, the portable music player PL is linked to the carabiner 5, which is to be attached to the user, through the pine needle string 8, to which the present invention is not restricted, and, by attaching the pine needle string 8 to the lower part of the housing 3, the portable music player PL may be linked to the housing 3 through pine needle string 8.

Figure 13:
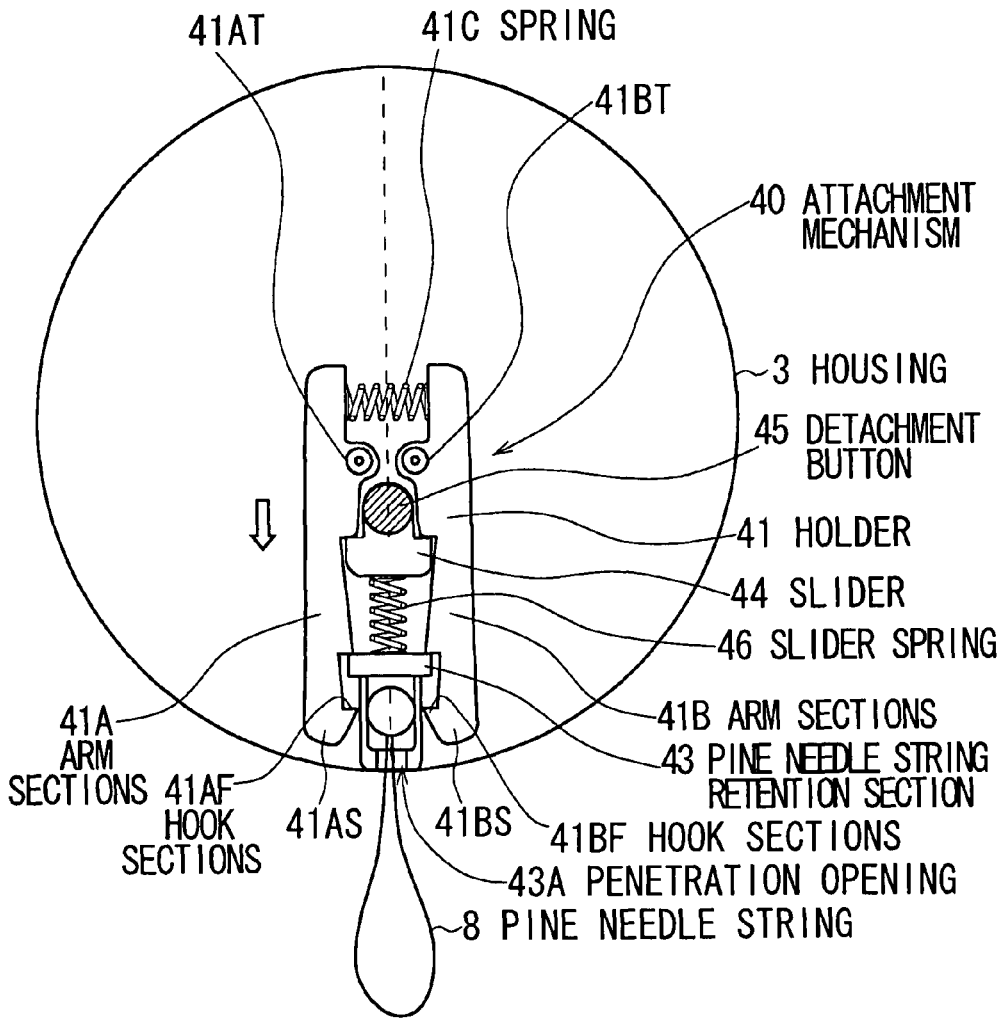
FIG. 13 shows a schematic view indicative of the configuration of an attachment mechanism (1) for a pine needle string in another embodiment.

In this case, as shown in FIG. 13, an attachment mechanism 40 to attach the pine needle string 8 to the housing 3 is arranged at the inside of the housing 3 separately from the reeling mechanism 20 (FIG. 8 and FIG. 9) for the headphone cord 2C.

This attachment mechanism 40 has a holder 41 in the form of a clothespin which is arranged at substantially the center of the housing 3. The holder 41 has two arm sections 41A and 41B, and leading end sections 41AS and 41BS of the arm sections 41A and 41B are opened and closed with fulcrums 41AT and 41BT being the opening and closing axes. In the attachment mechanism 40, usually, the leading end section 41AS of the arm section 41A and the leading end section 41BS of the arm section 41B are closed due to the biasing force of a spring 41C.

Accordingly, usually, the holder 41 holds a pine needle string retention section 43 at the inside of the leading end sections 41AS and 41BS, and the pine needle string 8 retained by the pine needle string retention section 43 is hung from the lower part of the housing 3.

Figure 14:
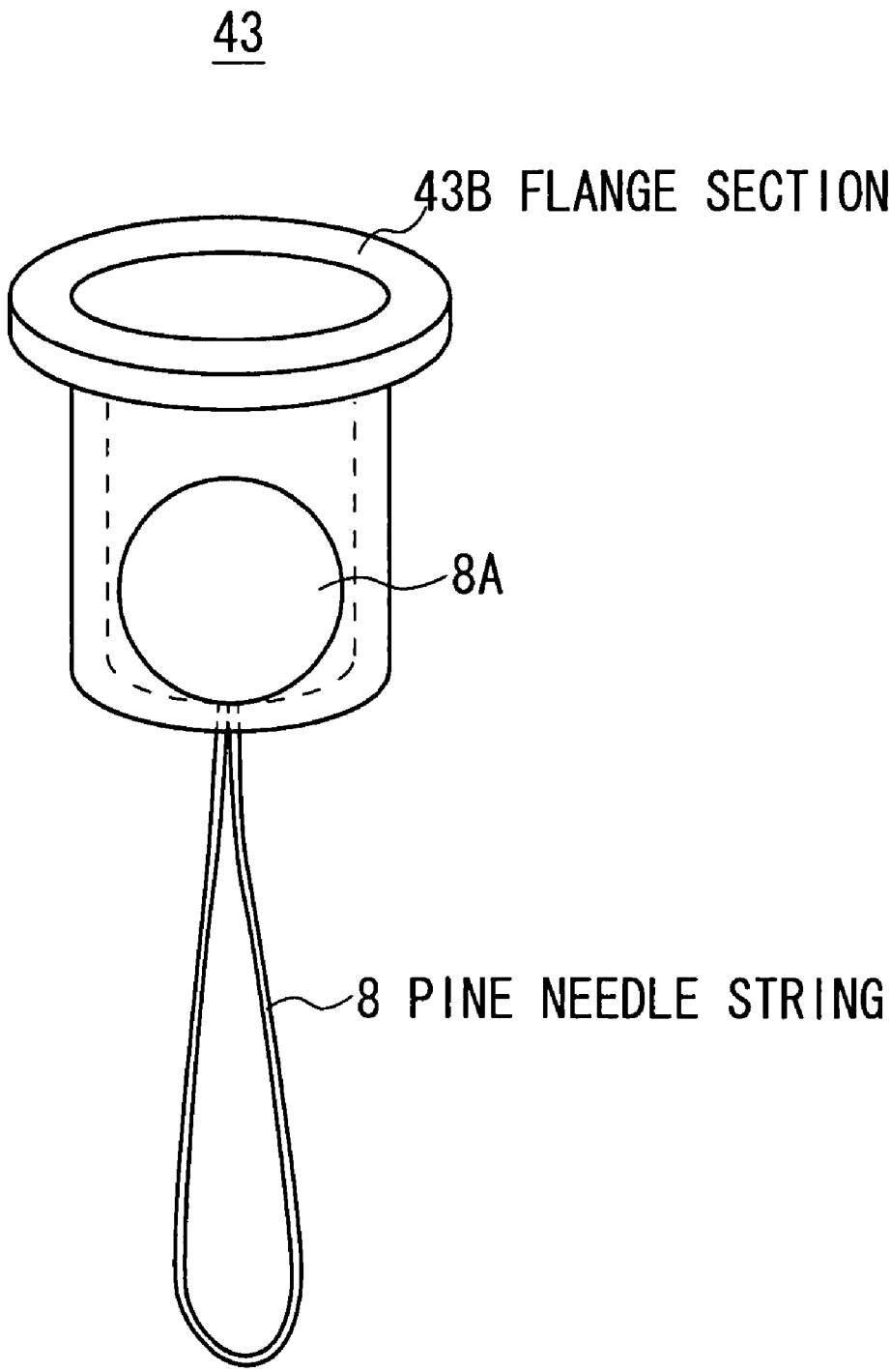
FIG. 14 shows a perspective view indicative of the configuration of a pine needle string retention section.

As shown in FIG. 14, the pine needle string retention section 43 is substantially in the form of a cylinder, and is provided with, at the bottom thereof, a small penetration opening 43A (FIG. 13) through which only the pine needle string 8 pass, and has formed thereon, at the top thereof, a flange section 43B (FIG. 14) to be retained by the leading end sections 41AS and 41BS of the holder 41.

The pine needle string 8 has, at one end thereof, a ball section 8A in the form of a ball of a predetermined size, which functions as a stopper at the bottom of the pine needle string retention section 43 to prevent the pine needle string 8 from falling off. Accordingly, when the user detaches the pine needle string 8 from the pine needle string retention section 43 and makes a knot at the midstream of the pine needle string 8, the knot plays the role of a stopper instead of the ball section 8A, which can adjust the length of the pine needle string 8 hung from the lower part of the housing 3.

When the pine needle string retention section 43 is pressed into the inside of the holder 41 from the lower part of the housing 3, the outer circumference of the flange section 43B outspreads the leading end sections 41AS and 41BS of the arm sections 41A and 41B of the holder 41, and the pine needle string retention section 43 is retained by the holder 41 when hook sections 41AF and 41BF of the leading end sections 41AS and 41BS are engaged with the flange section 43B.

On the other hand, the arm sections 41A and 41B are so formed as to be inclined or tapered such that the inner space sandwiched by the arm sections 41A and 41B becomes narrow as heading for the leading end thereof, and when a detachment button 45 of a slider 44 in the form of the inverted character "T" is slid downward in a direction of an arrow, the arm sections 41A and 41B are outspread against the biasing force of the spring 41C. As a result, the engaged state of the flange section 43B of the pine needle string retention section 43 and the hook sections 41AF and 41BF of the holder 41 is released. In this way, the pine needle string retention section 43 is detached from the holder 41.

Usually, the slider 44 is biased upward by a slider spring 46, and the arm sections 41A and 41B of the holder 41 are not outspread so long as the detachment button 45 is not pushed down. That is, after the pine needle string retention section 43 is attached to the holder 41 once, so long as the slider 44 is not pushed down through the detachment button 45, the pine needle string retention section 43 is not detached from the holder 41.

Also in this case, when the pine needle string 8 is detached from the pine needle string retention section 43, and the pine needle string 8 is attached to the carabiner 5, the portable music player PL can be attached to the carabiner 5 through the pine needle string 8.

In this way, according to the headphone device 1, the portable music player PL can be linked to the housing 3 in series through the pine needle string 8 hung from the lower part of the housing 3, and the portable music player PL can also be attached to the carabiner 5 through the pine needle string 8, which can enlarge the degree of freedom in attaching the portable music player PL to the housing 3.

Furthermore, in the first embodiment, by winding the connecting cord 7 pulled out from the rear surface 3B of the housing 3 between the connecting cord winding section 6D of the protective cover 6 and the surface 6E of the protective cover 6, the length of the connecting cord 7 can be adjusted, to which the present invention is not restricted, and the cord length may be adjusted by providing a cord storage space at the inside of the housing 3 and storing unnecessary cord part therein.

Figure 15A:
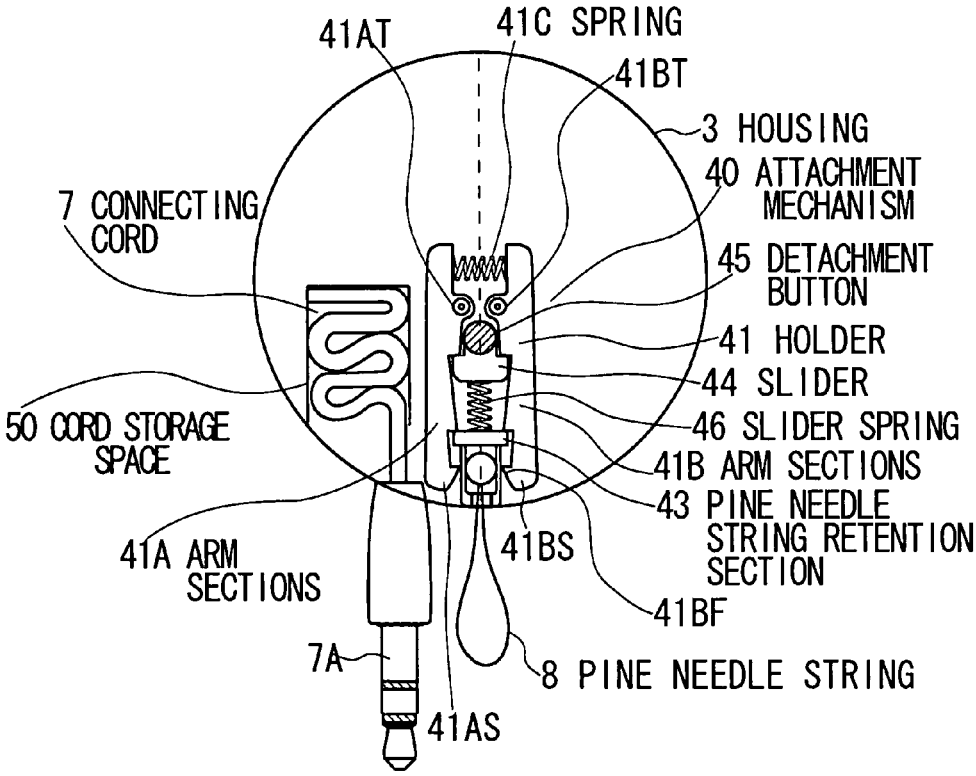
FIG. 15A and FIG. 15B show schematic views indicative of the storage structure (1) for the connecting cord in another embodiment.

In this case, as shown in FIG. 15A, there may be considered a configuration in which a cord storage space 50 is provided next to the attachment mechanism 40 arranged at the inside of the housing 3. Accordingly, the user can adjust the cord length by pressing unnecessary cord part of the connecting cord 7 into the cord storage space 50 from the lower part of the housing 3.

Figure 15B:
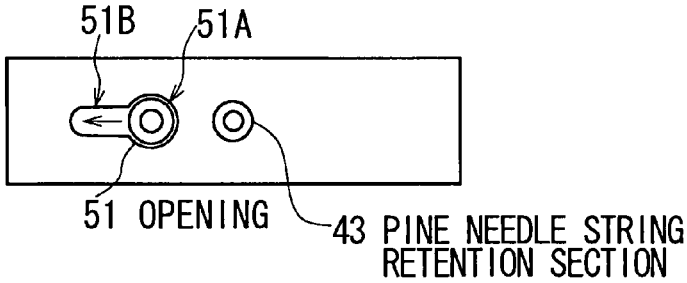

As shown in FIG. 15B, at the housing 3, an opening 51 in the form of a calabash through which the connecting cord 7 is stored in the cord storage space 50 is formed, and the cord part of the connecting cord 7 is pressed into the cord storage space 50 through a storage section 51A which is larger than the diameter of the cord part, and is then pressed into a retention section 51B which is smaller than the diameter of the cord part. Then, the connecting cord 7 can be retained with the surface of the cord part slightly crushed.

Accordingly, after the length of the connecting cord 7 is adjusted to a length desired by the user, the connecting cord 7 can be retained by the retention section 51B of the opening 51. Thus, the connecting cord 7 can be freely adjusted without exposing unnecessary cord part thereof to the outside of the housing 3.

Furthermore, in the first embodiment, when the headphone cord 2C of the headphone 2 is wound around the reel 21 at the inside of the housing 3, the ear installation sections 2A and 2B of the headphone 2 is retained at the opening 3A of the housing 3, to which the present invention is not restricted, and the ear installation sections 2A and 2B may be attached to be fixed to a retention section in the form of a predetermined figuration which is arranged on the surface of the housing 3.

Figure 16:
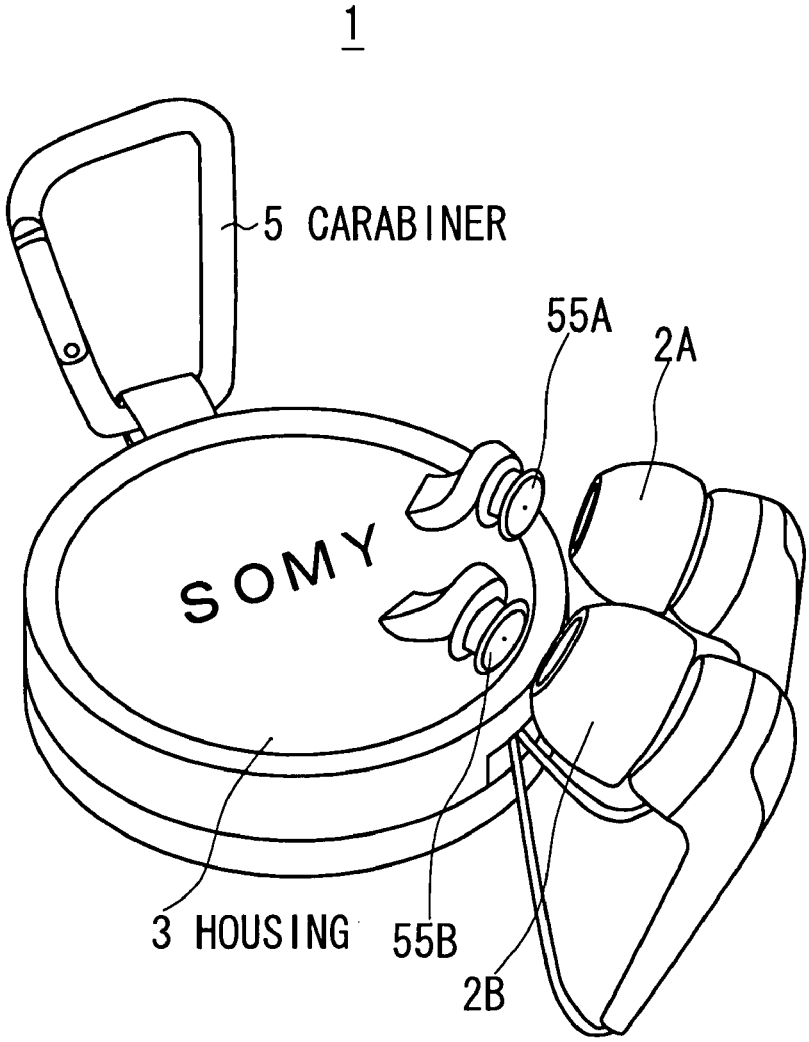
FIG. 16 shows a perspective view to explain the method of attaching and fixing the connecting cord in another embodiment.

For example, as shown in FIG. 16, there may be considered a configuration in which convex sections 55A and 55B for attaching and fixing the ear installation sections 2A and 2B are formed on the surface of the housing 3. In this case, when the ear installation sections 2A and 2B of the headphone 2 are fitted to the convex sections 55A and 55B, the ear installation sections 2A and 2B are attached to be fixed to the surface of the housing 3 with the headphone cord 2C of the headphone 2 wound around the reel 21 at the inside of the housing 3.

Furthermore, there may be considered a configuration in which two concave sections (not shown) for attaching and fixing the ear installation sections 2A and 2B of the headphone 2 are formed on the surface of the housing 3. In this case, similarly, when the ear installation sections 2A and 2B of the headphone 2 are fitted to the two concave sections, the ear installation sections 2A and 2B are attached to be fixed to the surface of the housing 3 with the headphone cord 2C of the headphone 2 wound around the reel 21 at the inside of the housing 3.

Figure 17:
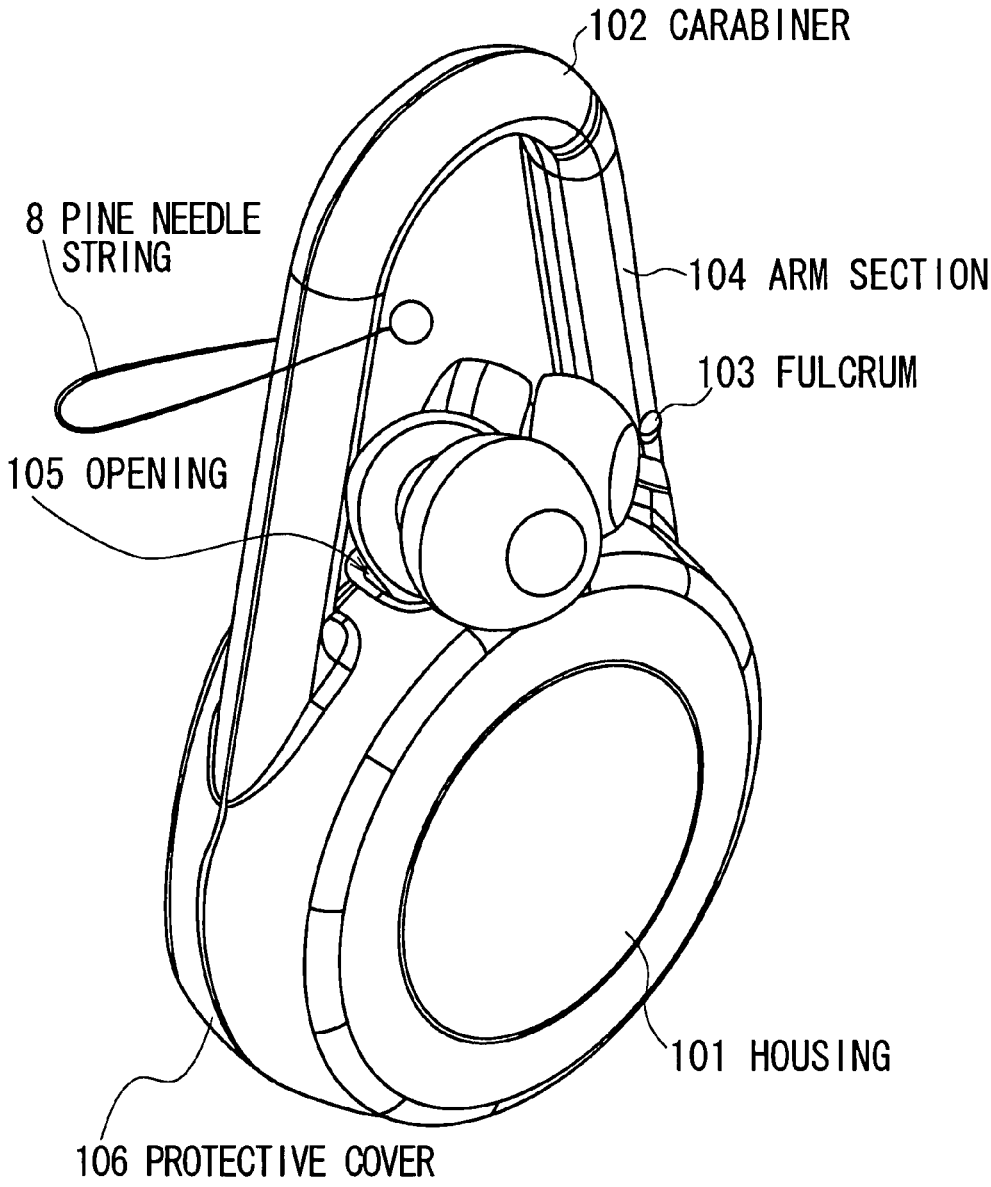
FIG. 17 shows a perspective view indicative of the exterior appearance configuration (1) of a headphone device in the second embodiment.
Figure 18:
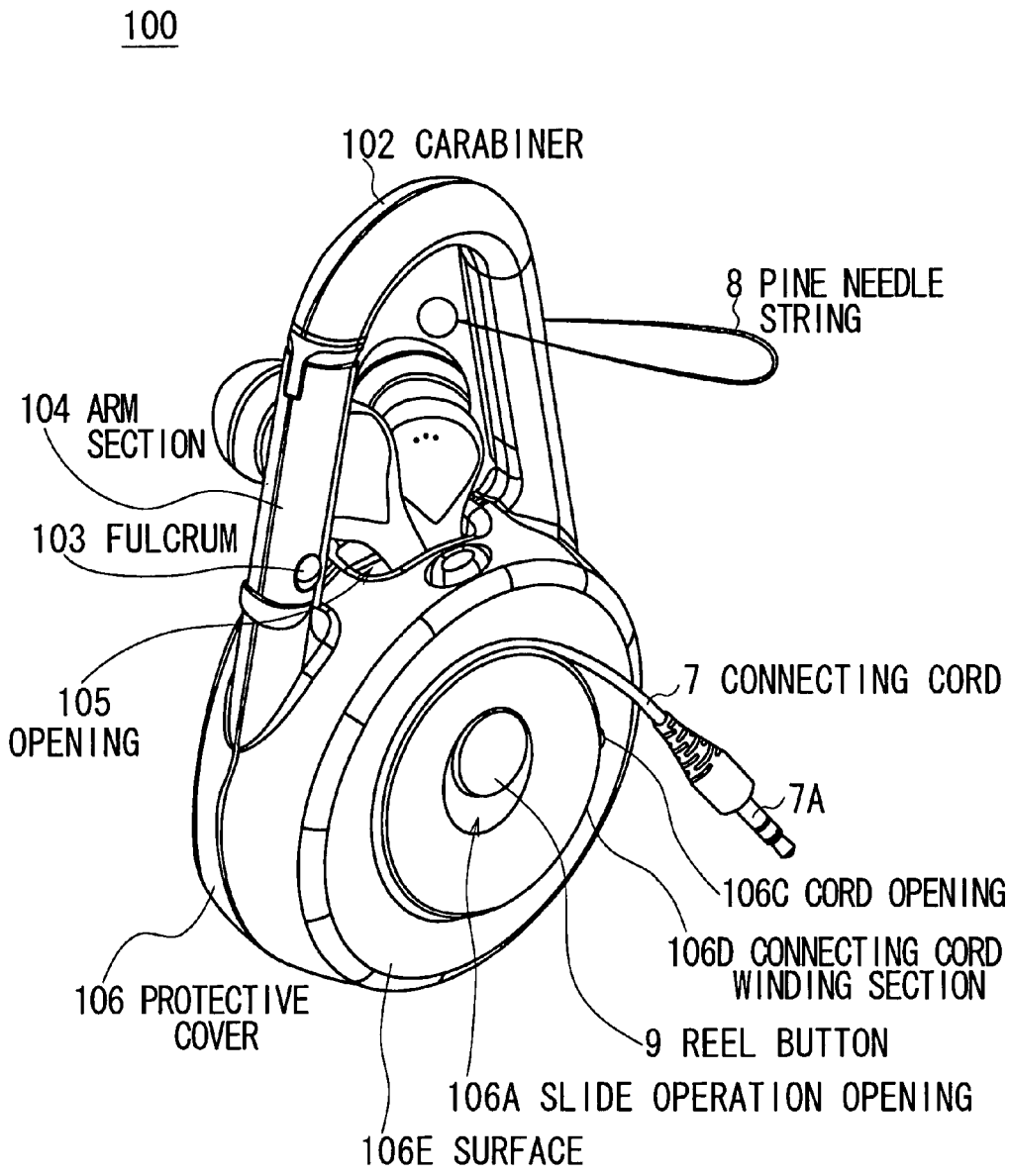
FIG. 18 shows a perspective view indicative of the exterior appearance configuration (2) of the headphone device in the second embodiment.
Figure 19:
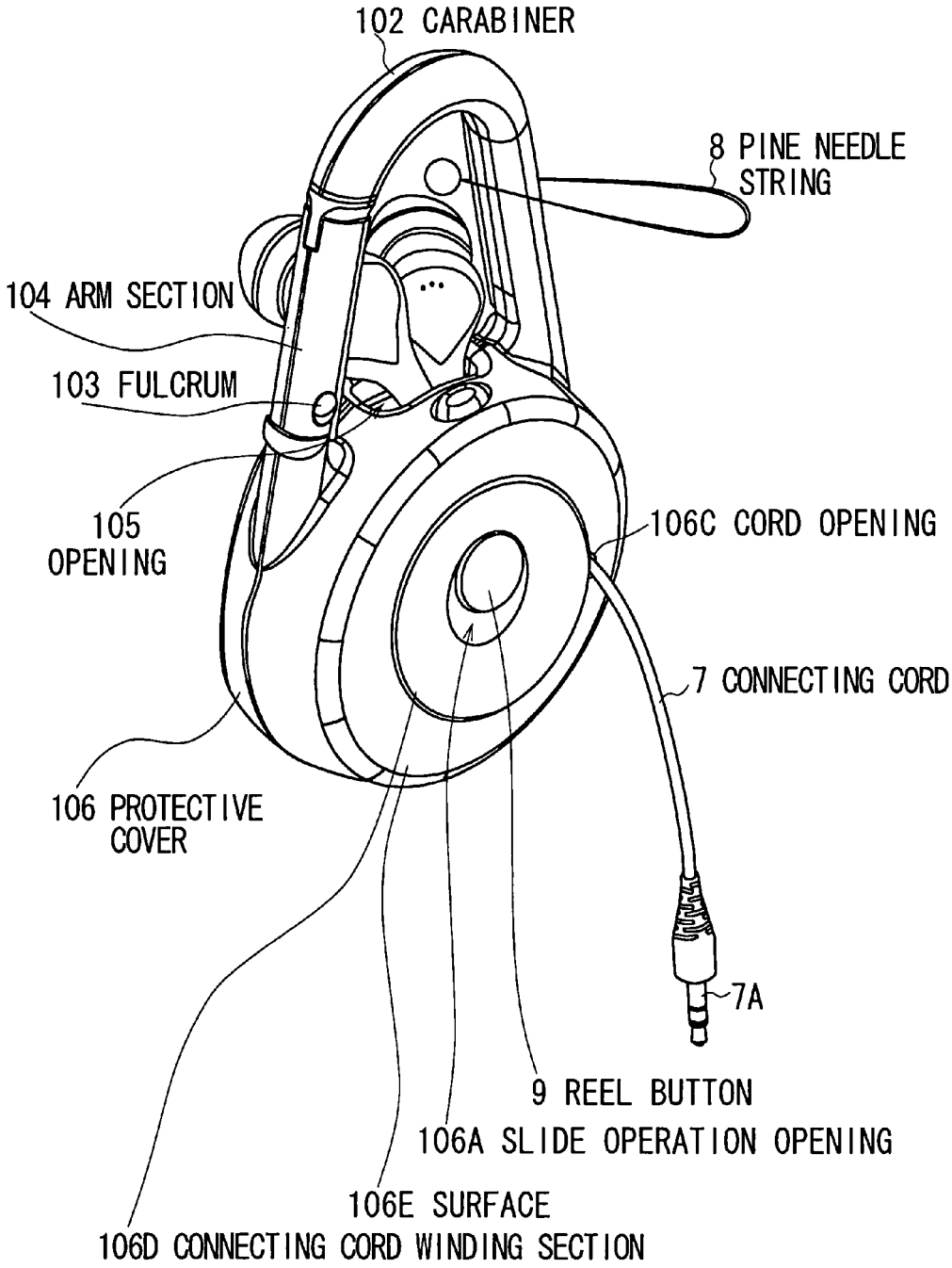
FIG. 19 shows a perspective view indicative of the exterior appearance configuration (3) of the headphone device in the second embodiment.

(2) Second Embodiment (2-1) External Appearance Configuration of a Headphone Device in the Second Embodiment In FIG. 17 to FIG. 19, in which parts or components similar to those shown in FIG. 1 to FIG. 3 are indicated with the same reference numerals, a reference numeral "100" represents a headphone device according to the second embodiment of the present invention. In the headphone device 100, the headphone cord 2C, not shown, of the headphone 2 is reeled up by the reeling mechanism 20 (FIG. 8 and FIG. 9) arranged in a housing 101 in the form of a cylinder, and to the top end of the housing 101, a carabiner 102 to be attached to the user is unitedly attached.

The carabiner 102 is substantially in the form of the character "U", and, since the carabiner 102 is unitedly attached to the housing 101 at the top end thereof, being different from the headphone device 1 of the first embodiment in which the housing 3 and the carabiner 5 are separately formed, the headphone device 100 expresses the sense of unity such that the whole headphone device 100 can be attached to a belt loop of trousers.

The carabiner 102 is configured such that an arm section 104, which is a part of the carabiner 102, pivots to the inside with a fulcrum 103 being the pivot axis. Usually, the arm section 104 is pressed by a biasing force of a spring, not shown, arranged at the inside of the fulcrum 103 to form one side of the substantially inverted character "U", while, when being pressed by the user, the arm section 104 pivots to the inside of the substantially inverted character "U" against the biasing force, and the carabiner 102 is attached to a belt loop of trousers.

It is supposed that the carabiner 102 is attached to a belt loop of trousers. On the other hand, in addition, the carabiner 102 is so formed as to have a strength that can stand up to a case in which, for example, the portable music player PL which supplies music signals etc. to the headphone 2 is attached to the carabiner 102 through the pine needle string 8, or a case in which a key or other objects are attached to the carabiner 102.

In the headphone device 100, through an opening 105 which is provided on the top end of the housing 101 and at the inner side of the carabiner 102, the ear installation sections 2A and 2B which are leading ends of the headphone 2 are held. The ear installation sections 2A and 2B have their size made larger than that of the opening 105, which prevents, when the reel button 9 (FIG. 18 and FIG. 19) is slid downward to operate a reeling mechanism and the headphone cord 2C, not shown, of the headphone 2 is reeled up, the ear installation sections 2A and 2B of the headphone 2 from being housed at the inside of the housing 101 to make it difficult to pull out the ear installation sections 2A and 2B.

Concurrently, in the headphone device 100, when the headphone cord 2C, not shown, of the headphone 2 is wound at the inside of the housing 101, since the ear installation sections 2A and 2B of the headphone 2 come to be located at a space formed by the top end of the housing 101 and the inner side of the carabiner 102, the ear installation sections 2A and 2B can be protected from the outside by the carabiner 102.

Furthermore, in the headphone device 100, a protective cover 106 made of rubber is attached to the surface of the housing 101, which prevents, in case the housing 101 is attached to a portable music player, not shown, with their positions set adjacent to each other through the carabiner 102, both the housing 101 and portable music player from being scratched or damaged when the housing 101 and portable music player come into contact with each other or collide with each other.

In the headphone device 100, from a point near the reel button 9 arranged at the rear surface of the housing 101, the connecting cord 7 to be electrically connected to an electronic device such as the portable music player PL, not shown, is drawn from a cord opening 106C (FIG. 19) of the protective cover 106.

On the other hand, the protective cover 106 for covering the housing 101 is provided with, substantially at the center thereof, a slide operation opening 106A in the form of a vertically long ellipse of a size corresponding to the shift range of the reel button 9 which is operated to be slid downward.

The headphone device 100 comes to be a completed device when the housing 101 is covered by the protective cover 106, in which state the connecting cord 7 of the housing 101 is exposed to the outside through the cord opening 106C of the protective cover 106, and the reel button 9 is exposed to the outside through the slide operation opening 106A.

Furthermore, the protective cover 106 has formed thereon a connecting cord winding section 106D, around the slide operation opening 106A, which is in the form of a thin ring plate and slightly protrudes from the surface 106E of the protective cover 106, and, as shown in FIG. 18, the connecting cord 7 that is exposed from the cord opening 106C can be wound between the connecting cord winding section 106D and the surface 106E.

Accordingly, since the connecting cord 7 exposed to the outside from the cord opening 106C of the protective cover 106 is wound between the connecting cord winding section 106D and the surface 106E, the headphone device 100 can make the length of the connecting cord 7 short. On the other hand, when the connecting cord 7 is not wound between the connecting cord winding section 106D and the surface 106E, the headphone device 100 can be used with the length of the connecting cord 7 made maximally long.

At this time, since the protective cover 106 is made of rubber provided with the elasticity, the connecting cord 7 is sandwiched between the connecting cord winding section 106D and the surface 106E due to the elastic force of the protective cover 106, and can be held at a position with its length arbitrarily adjusted.

Since the connecting cord winding section 106D is so formed as to slightly protrude from the surface 106E of the protective cover 106, the reel button 9 which is exposed at the inner side of the slide operation opening 106A does not protrude from the surface of the connecting cord winding section 106D, which prevents the reel button 9 from being operated carelessly.

In addition, the reel button 9 is not a button of the push operation type but a button of the slide operation type, which also prevents the reel button 9 from being operated incorrectly, and configures a double erroneous operation prevention mechanism together with the configuration in which the reel button 9 does not protrude from the surface of the connecting cord winding section 106D.

Figure 20:
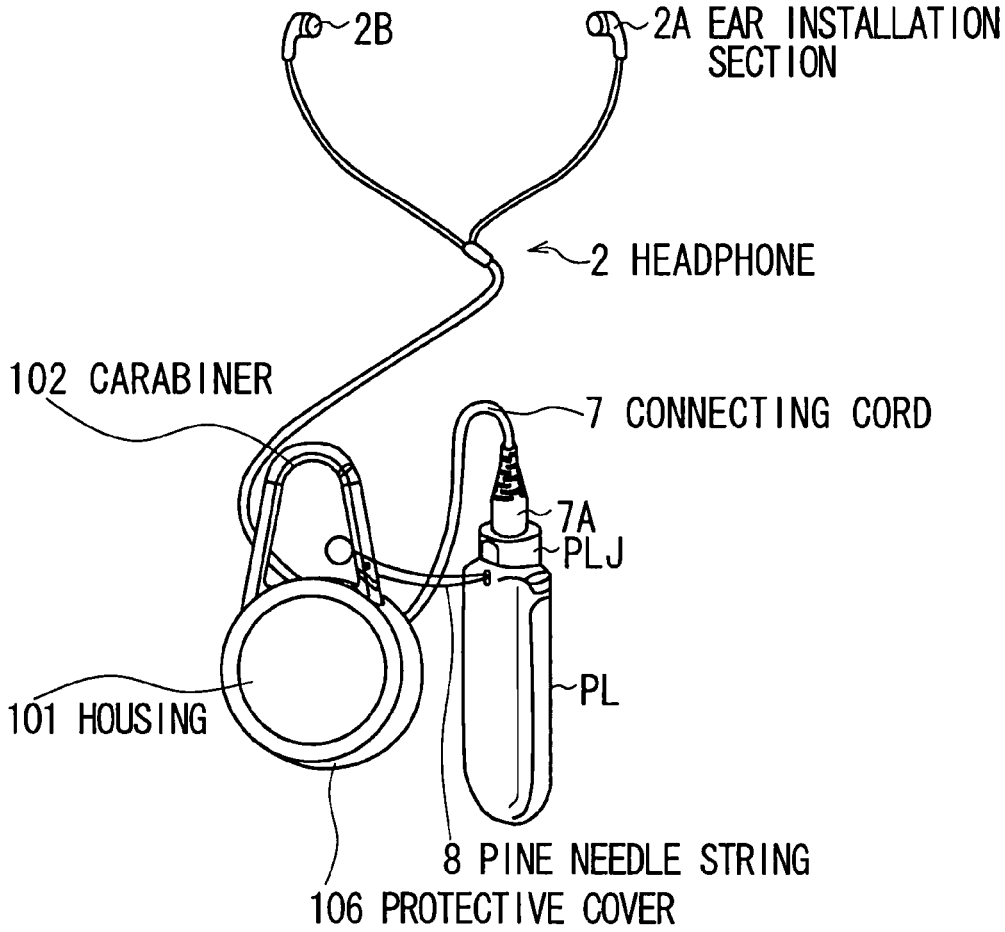
FIG. 20 shows a perspective view indicative of the state in which a portable music player is attached to the headphone device in the second embodiment.

Actually, as shown in FIG. 20, in the headphone device 100, the portable music player PL is attached to the carabiner 102 through the pine needle string 8, which carabiner 102 is united with the housing 101 covered by the protective cover 106.

When a plug 7A of the connecting cord 7 exposed from the housing 101 through the cord opening 106C of the protective cover 106 is inserted to the jack PLJ of the portable music player PL, the headphone device 100 and the portable music player PL are mechanically and electrically connected.

Accordingly, when the carabiner 102 is attached to a belt loop of trousers, the user carrying the headphone device 100 and portable music player PL about, the headphone device 100 can supply music signals reproduced by the portable music player PL to the headphone 2 through the connecting cord 7, which can make the user listen to music through the ear installation sections 2A and 2B of the headphone 2.

(2-2) Reeling Mechanism of the Headphone Device in the Second Embodiment

The configuration of a reeling mechanism arranged at the inside of the housing 101 of the headphone device 100 is similar to that of the reeling mechanism of the headphone device 1 in the first embodiment, and the explanation of which is omitted for the sake of convenience.

(2-3) Performance and Effect

In above-described configuration, according to the headphone device 100, for example, the housing 101 can be attached to a belt loop of trousers through the carabiner 102, and, under this state, when the user pulls out the ear installation sections 2A and 2B of the headphone 2, the length of the headphone cord 2C can be adjusted to a length desired by the user.

In this state, the headphone device 100 can output music reproduced by the portable music player PL that is linked to the carabiner 102 using the pine needle string 8 from the ear installation sections 2A and 2B of the headphone 2 to make the user listen to thus reproduced music.

In this way, according to the headphone device 100, when being used, the portable music player PL does not come to be located at the chest of the user, and the portable music player PL is not appended at the chest of the user through a strap hung from the neck as in the past, which can prevent the user from feeling a sensation of pressure to the chest, feeling uncomfortable, or feeling a sensation of pressure to the chest when walking up and down the stairs, and furthermore, the portable music player PL is not offending when putting off a jacket, or does not get wet with water of a washstand when the user turns down his or her upper body to wash hands, solving all the inconvenient problems.

Furthermore, according to the headphone device 100, since the portable music player PL is not put in a chest pocket of clothes as in the past, the portable music player PL does not fall down when the user turns down his or her upper body, and clothes are not restricted due to the weight, size, etc. of the portable music player PL.

Furthermore, according to the headphone device 100, since the portable music player PL can be held at the lumbar part of the user, which part is near the user's hands, operations for convenient functions or displaying song titles for the user, adjusting sound volumes, selecting music can be easily performed, improving the convenience for the user significantly.

According to the headphone device 100, since the housing 101 that is united with the carabiner 102 is directly attached to clothes of the user through the carabiner 102, and also the portable music player PL can be attached to the user through the carabiner 102, the housing 101 and portable music player PL are attached to the user in parallel through the carabiner 102. Thus, when attached to a belt loop of trousers through the carabiner 102, the housing 101 and portable music player PL comes to be adjacent to each other like key rings, which can improve the fashionability when the headphone device 100 is used.

Then, when the user only slides the reel button 9 of the housing 101, the headphone device 100 can reel up the headphone cord 2C of the headphone 2 to the inside of the housing 101 instantly.

At this time, in the headphone device 100, since the ear installation sections 2A and 2B of the headphone 2 are retained at the opening 105 of the housing 101, and the ear installation sections 2A and 2B are made to be located at a space formed by the housing 101 and the carabiner 102, the ear installation sections 2A and 2B can be protected by the carabiner 102, and concurrently the ear installation sections 2A and 2B can be prevented from being lost.

Furthermore, when the headphone device 100 is not used, since the headphone cord 2C of the headphone 2 is housed at the inside of the housing 101, the headphone 2 and the headphone cord 2C are not cumbersome around the lumbar part of the user, which can improve the portability and fashionability even when the headphone device 100 is not used.

When the headphone device 100 is attached to clothes of the user, while the portable music player PL linked to the carabiner 102 through the pine needle string 8 and the housing 101 united with the carabiner 102 collide with each other when the user walks, since the housing 101 is covered by the protective cover 106, both the housing 101 and portable music player PL are prevented from being scratched or damaged.

According to above-described configuration, being provided with the portability and operability concurrently, the headphone device 100 can further become excellent and user-friendly as compared with that in the past.

(2-4) Another Embodiment with Respect to the Second Embodiment

Figure 21:
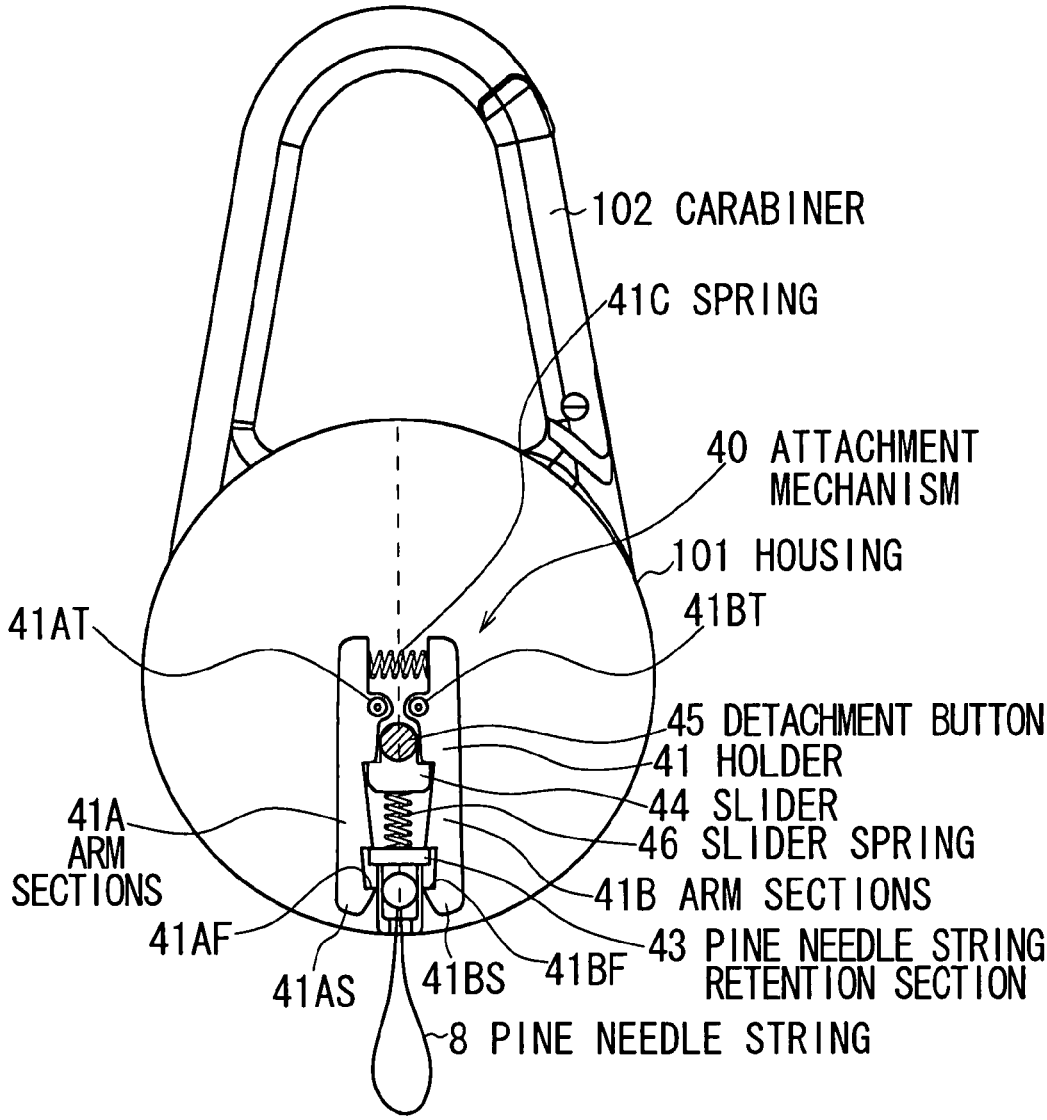
FIG. 21 shows a schematic view indicative of the configuration of an attachment mechanism (2) for a pine needle string in another embodiment.

In above-described second embodiment, the portable music player PL is linked to the carabiner 102, which is to be attached to the user, through the pine needle string 8, to which the present invention is not restricted, and, similar to the housing 3 of the headphone device 1 in the first-embodiment, as shown in FIG. 21 in which parts or components similar to those shown in FIG. 13 are indicated with the same reference numerals, by attaching the pine needle string 8 to the lower part of the housing 101 through the attachment mechanism 40, the portable music player PL may be linked to the housing 101 through pine needle string 8. The configuration of the attachment mechanism 40 for the pine needle string 8 is similar to that of the attachment mechanism 40 shown in FIG. 12, and the explanation of which is omitted for the sake of convenience.

Figure 22A:
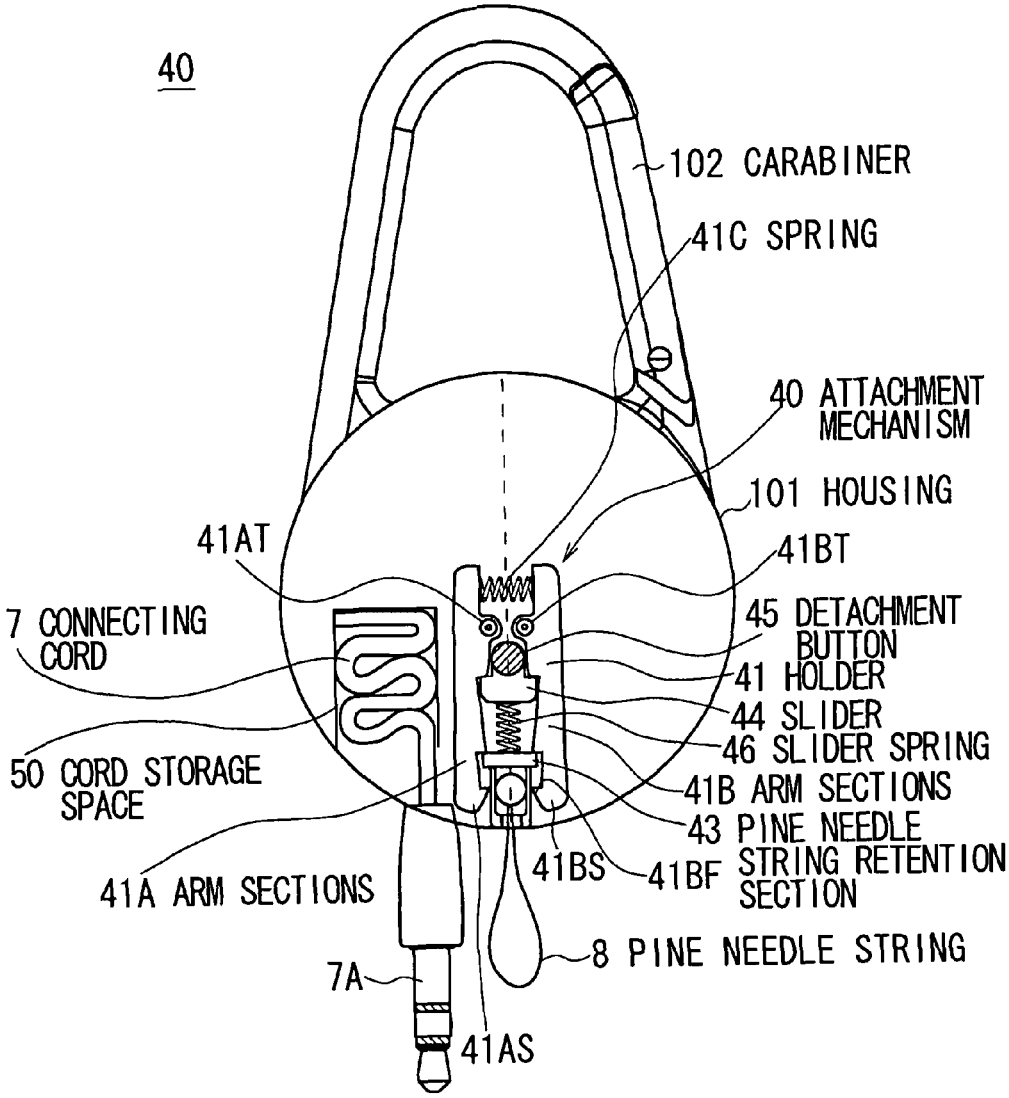
FIG. 22A and FIG. 22B show schematic views indicative of the storage structure (2) for the connecting cord in another embodiment.
Figure 22B:
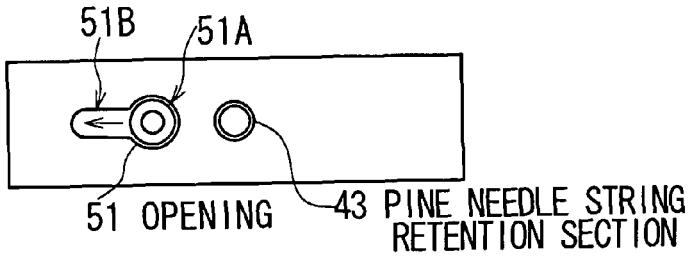

Furthermore, in the second embodiment, by winding the connecting cord 7 pulled out from the rear surface of the housing 101 between the connecting cord winding section 106D of the protective cover 106 and the surface 106E of the protective cover 106, the length of the connecting cord 7 can be adjusted, to which the present invention is not restricted, and, as shown in FIG. 22A and FIG. 22B in which parts or components similar to those shown in FIG. 15A and FIG. 15B are indicated with the same reference numerals, the cord length may be adjusted by providing a cord storage space 50 at the inside of the housing 101 and storing unnecessary cord part therein. The configuration of the cord storage space 50 is similar to that of the cord storage space 50 shown in FIG. 15A and FIG. 15B, and the explanation of which is omitted for the sake of convenience.

(3) Other Embodiments with Respect to the First and Second Embodiments

In the first and second embodiments, the headphone device 1 or headphone device 100 is attached to a belt loop of trousers through the carabiner 5 or carabiner 102, to which the present invention is not restricted, and the headphone device 1 or headphone device 100 may be attached not only to clothes and trousers but also to objects which the user carries about such as a bag.

Figure 23:
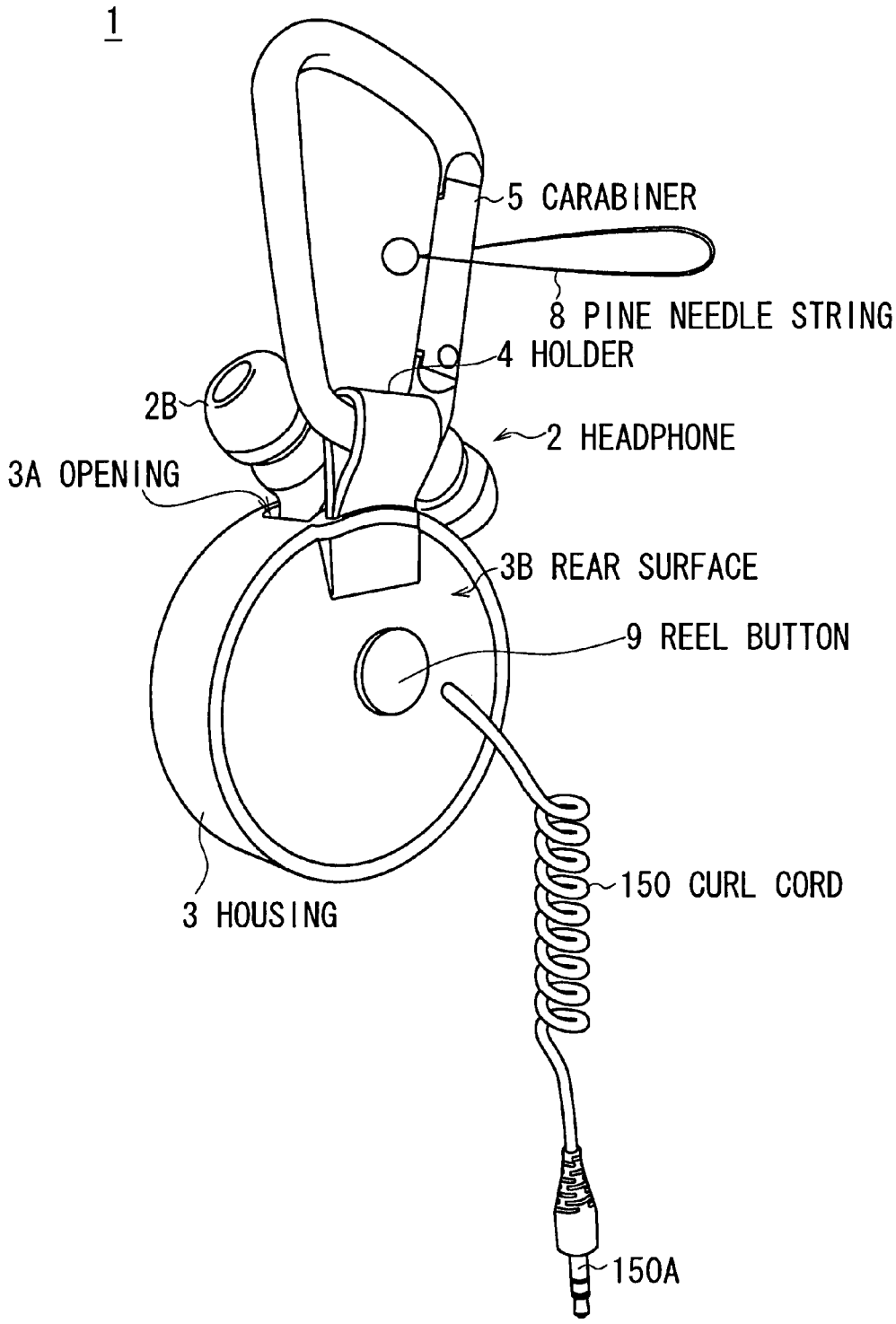
FIG. 23 shows a perspective view indicative of a curl cord (1) in another embodiment.
Figure 24:
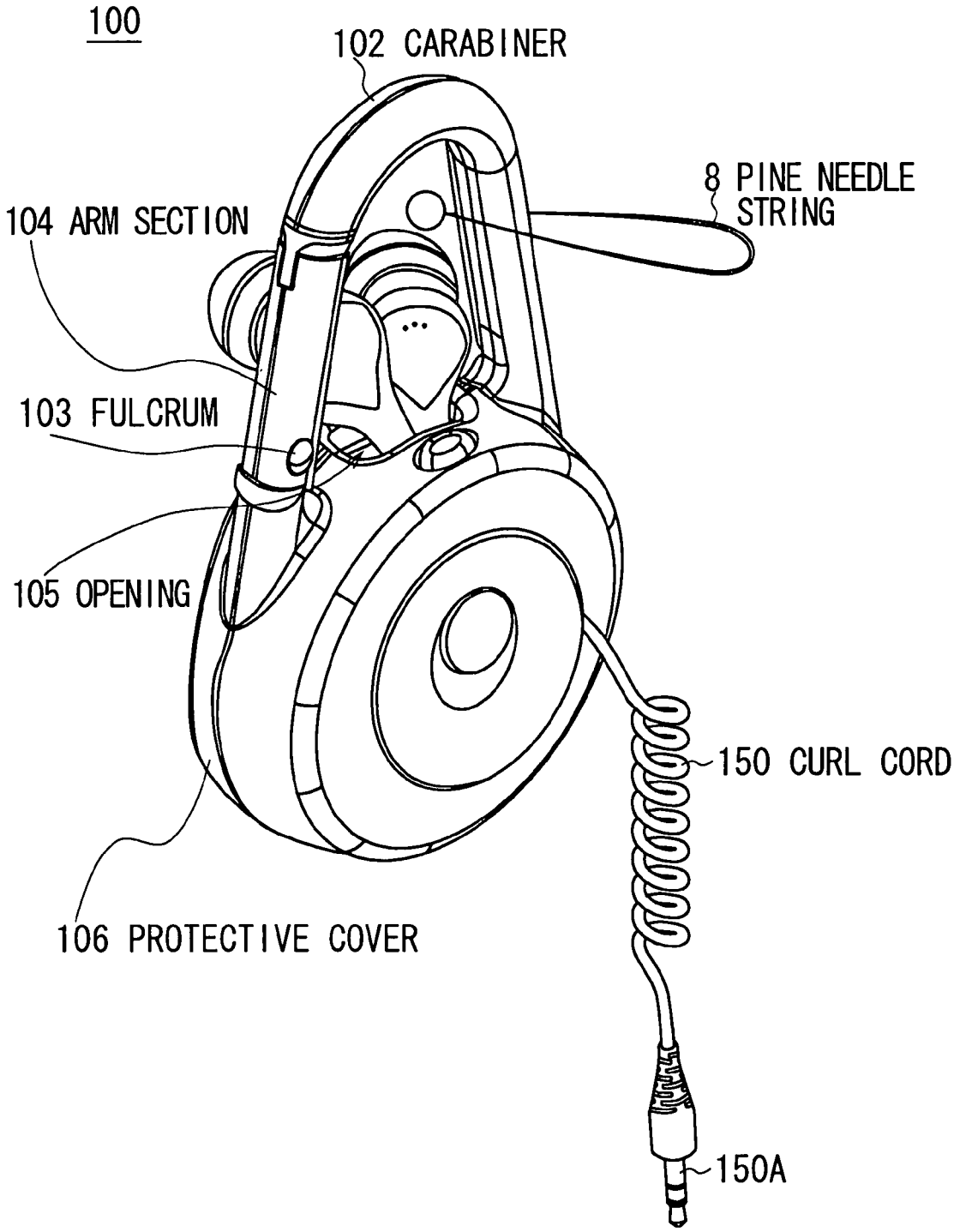
FIG. 24 shows a perspective view indicative of a curl cord (2) in another embodiment.

Furthermore, in the first and second embodiments, by winding the connecting cord 7 between the connecting cord winding section 6D or 106D and the surface 6E or 106E, the cord length can be adjusted, to which the present invention is not restricted, and, as shown in FIG. 23 and FIG. 24, a curl cord 150 may be employed instead of the connecting cord 7.

Moreover, in the first and second embodiments, by winding the connecting cord 7 between the connecting cord winding section 6D or 106D in the form of a thin ring plate and the surface 6E or 106E, the cord length can be adjusted, to which the present invention is not restricted, and the connecting cord 7 may be wound between a connecting cord winding section of other various figurations other than a thin ring plate such as a thin rectangular plate and the surface 6E or 106E, so long as the connecting cord winding section is of a configuration around which the connecting cord 7 can be wound.

Yet moreover, in the first and second embodiments, there is employed the reeling mechanism 20 in which the headphone cord 2C of the headphone 2 is wound around the reel 21 when the engaged state of the lock click section 32 of the ratchet wheel 31 and the leading end of the lock lever 33 is released, to which the present invention is not restricted, and there may be employed a reeling mechanism using a ball bearing or a reeling mechanism of other various configurations.

Figure 25:
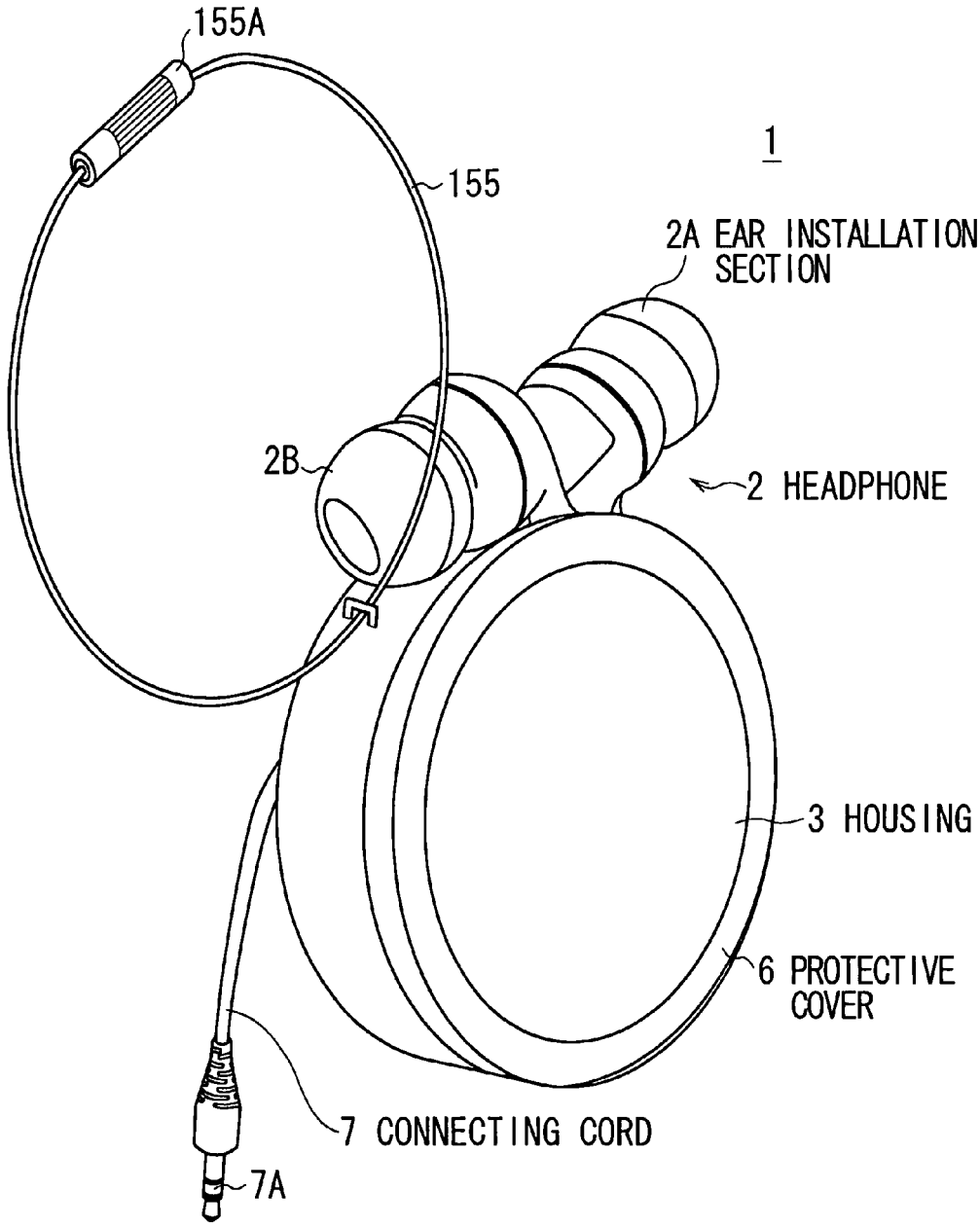
FIG. 25 shows a perspective view indicative of a wire in another embodiment.

Yet moreover, in the first and second embodiments, the carabiner 5 as an attachment unit as well as a hook has its inner closed space substantially in the form of a triangle hooked by a belt loop of trousers, while the carabiner 102 as an attachment unit as well as a hook has its inner space substantially in the form of the inverted character "U", which is formed when united with the housing 101, hooked by a belt loop of trousers, to which the present invention is not restricted, and, as shown in FIG. 25, there may be employed a wire 155 that can be unlinked at a screw section 155A arranged at the midstream of the ring as an attachment unit, or there may be employed a general hook which is not provided with an inner closed space or an attachment unit of other various figurations to be attached to the user.

Yet moreover, in the first and second embodiments, the pine needle string 8 is used as a link section, to which the present invention is not restricted, and a link section of other various configurations such as a wire string and a chain may be employed so long as the portable music player PL can be linked using the link section.

The headphone device according to the embodiments of the present invention can also be applied to various electronic devices provided with the music reproduction function other than the portable music player such as a cellular phone and a small-sized mobile computer.

It should be understood by those skilled in the art that various modifications, combinations, sub-combinations and alterations may occur depending on design requirements and other factors insofar as they are within the scope of the appended claims or the equivalents thereof.

What is claimed is:

1. A device that is connected to an electronic device through a connecting cord comprising:

a housing;

a reeling section that reels up a headphone cord of a headphone to the inside of the housing;

an attachment section that is arranged on the housing, and is to be attached to the user; and a link section that physically links any one of the housing and the attachment section to the electronic device, and wherein the housing has a length adjustment section in the form of a ring to adjust the length of the connecting cord, wherein the housing has a reel button that operates the reeling section is arranged at the inner side of the ring.

2. The device according to claim 1, wherein an audio signal is supplied from the electronic device through the connecting cord.

3. The device according to claim 1, wherein the housing has a length adjustment section that can adjust the length of the connecting cord.

4. The device according to claim 1, wherein the housing is provided with an opening of a size which can house the most part of ear installation sections which are arranged at the leading ends of the headphone cord in the housing in the state in which the headphone cord is reeled up by the reeling section.

5. The device according to claim 1, wherein the housing has a retention section formed on the surface thereof which retains ear installation sections which are arranged at the leading ends of the headphone cord in the state in which the headphone cord is reeled up by the reeling section.

6. The device according to claim 1, wherein the housing has its surface covered by a protective section that protects the housing.

7. The device according to claim 1, wherein the link section is a string.

8. The device according to claim 1, wherein the link section is a string that is retained by a string retention section which is attached to the lower part of the housing, and the string is retained by the string retention section such that the length of the string can be adjusted when the string retention section is detached from the housing.

9. The device according to claim 1, wherein the attachment section is a hook.

10. The device according to claim 1, wherein the attachment section is a hook that is unitedly arranged on the housing.

11. The device according to claim 1, wherein the attachment section is a hook substantially in the form of the inverted character "U" that is unitedly arranged on the housing, and an opening for the headphone cord is provided at the inner side of the hook.

12. A device that is connected to an electronic device through a connecting cord comprising:

a housing;

a reeling section that reels up a headphone cord of a headphone to the inside of the housing;

an attachment section that is arranged on the housing, and is to be attached to the user; and a link section that physically links any one of the housing and the attachment section to the electronic device, and wherein the housing has a length adjustment section in the form of a ring to adjust the length of the connecting cord, wherein the housing has a stretchable curl cord as the connecting cord.

* * * * *